US008555581B2

(12) United States Patent
Amend

(10) Patent No.: US 8,555,581 B2
(45) Date of Patent: Oct. 15, 2013

(54) EXTERIOR WALL FINISHING ARRANGEMENT

(76) Inventor: Victor Amend, Toronto (CA)

( * ) Notice: Subject to any disclaimer, the term of this patent is extended or adjusted under 35 U.S.C. 154(b) by 0 days.

(21) Appl. No.: 13/164,913

(22) Filed: Jun. 21, 2011

(65) Prior Publication Data

US 2012/0324814 A1 Dec. 27, 2012

(51) Int. Cl.
*E04B 1/70* (2006.01)

(52) U.S. Cl.
USPC ..... 52/302.1; 52/302.2; 52/302.6; 52/302.7; 52/506.05

(58) Field of Classification Search
USPC ..... 52/302.1, 302.2, 302.6, 302.7, 506.01, 52/506.05
See application file for complete search history.

(56) References Cited

U.S. PATENT DOCUMENTS

| | | | | |
|---|---|---|---|---|
| 5,927,032 | A * | 7/1999 | Record | 52/309.11 |
| 5,946,870 | A * | 9/1999 | Bifano et al. | 52/254 |
| 5,970,671 | A * | 10/1999 | Bifano et al. | 52/254 |
| 6,108,991 | A * | 8/2000 | Hagan et al. | 52/302.3 |
| 6,119,429 | A * | 9/2000 | Bifano et al. | 52/831 |
| 6,293,064 | B1 * | 9/2001 | Larson | 52/302.1 |
| 6,298,620 | B1 * | 10/2001 | Hatzinikolas | 52/302.1 |
| 6,470,638 | B1 * | 10/2002 | Larson | 52/302.1 |
| 6,619,004 | B2 | 9/2003 | Loper | |
| 6,698,144 | B1 * | 3/2004 | Larson | 52/202 |
| 6,886,301 | B2 * | 5/2005 | Schilger | 52/302.1 |
| 6,901,713 | B2 * | 6/2005 | Axsom | 52/481.1 |
| 6,990,775 | B2 * | 1/2006 | Koester | 52/302.1 |
| 7,367,165 | B2 * | 5/2008 | Hatzinikolas | 52/302.3 |
| 7,516,583 | B2 | 4/2009 | Mitchell | |
| 8,091,313 | B2 * | 1/2012 | Wilson et al. | 52/534 |
| 8,225,568 | B1 * | 7/2012 | Mollinger et al. | 52/302.4 |
| 2002/0108333 | A1 * | 8/2002 | Clayton | 52/302.1 |
| 2006/0005492 | A1 * | 1/2006 | Yohnke et al. | 52/405.2 |
| 2008/0098683 | A1 | 5/2008 | Trabue et al. | |
| 2008/0295439 | A1 | 12/2008 | Janesky | |
| 2009/0007509 | A1 * | 1/2009 | Jordan et al. | 52/302.1 |
| 2009/0282762 | A1 * | 11/2009 | Iske et al. | 52/302.1 |
| 2010/0251648 | A1 * | 10/2010 | Wilson et al. | 52/302.1 |
| 2010/0287865 | A1 | 11/2010 | Hatzinikolas | |
| 2011/0258944 | A1 * | 10/2011 | Radoane | 52/62 |
| 2011/0271622 | A1 * | 11/2011 | Wilson et al. | 52/302.1 |
| 2012/0073223 | A1 * | 3/2012 | Wilson et al. | 52/302.1 |
| 2012/0096790 | A1 * | 4/2012 | Wilson et al. | 52/302.1 |

* cited by examiner

*Primary Examiner* — Mark Wendell

(57) ABSTRACT

A finishing arrangement for an exterior wall of a building includes a weather or water barrier against at least the exterior of the wall; an outer hardboard panel; an insulating foam panel between the weather or water barrier and the outer hardboard panel, the insulating foam panel attached to the outer hardboard panel and having drainage channels therein; and a drainage guide that extends from the weather or water barrier to at least the outer hardboard panel, for guiding moisture away from the wall.

21 Claims, 23 Drawing Sheets

Fig.17
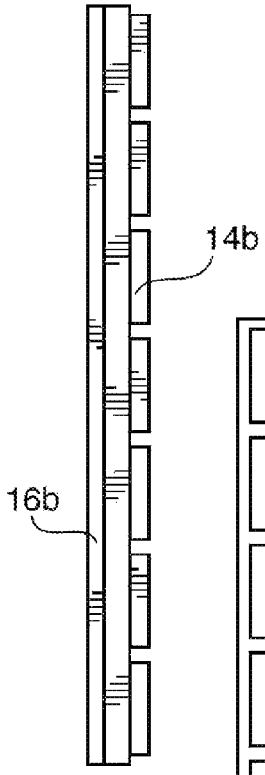
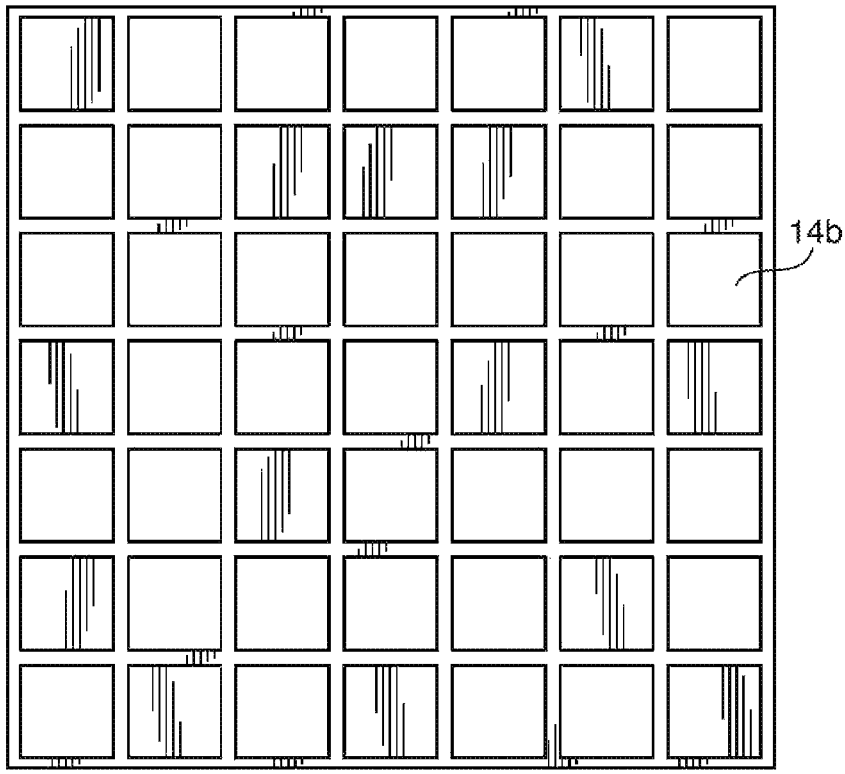
Fig.18

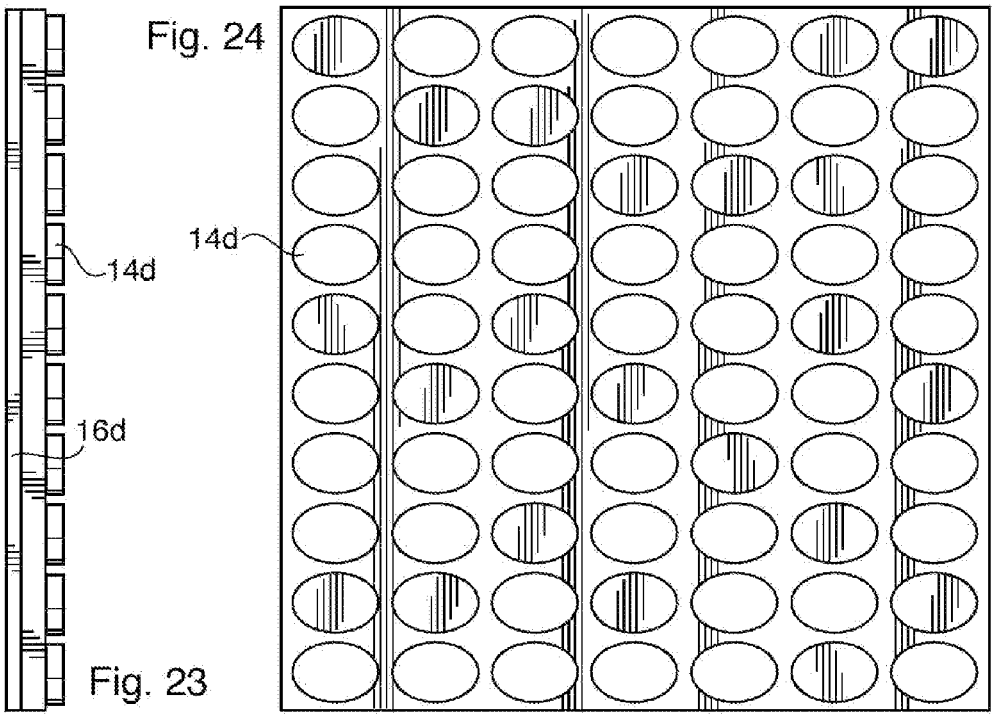
Fig. 24
Fig. 23
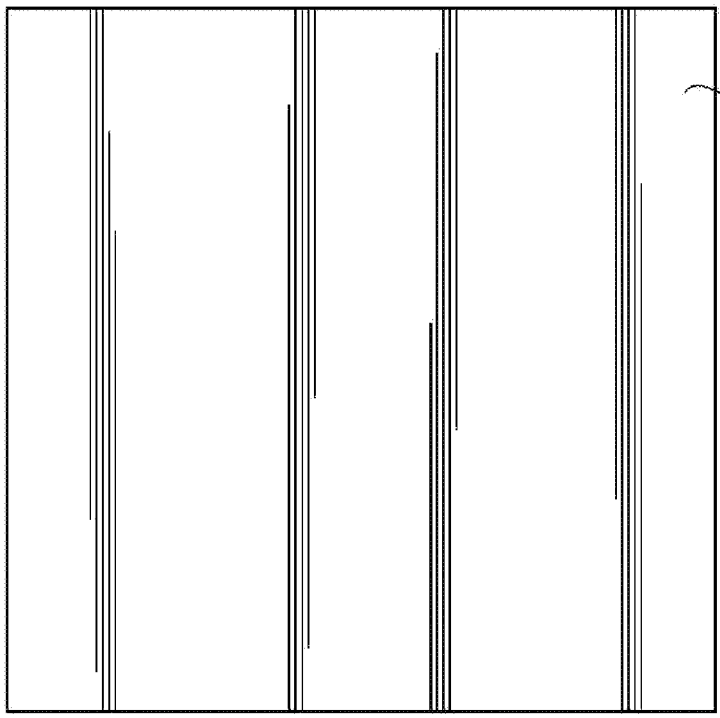
Fig. 25
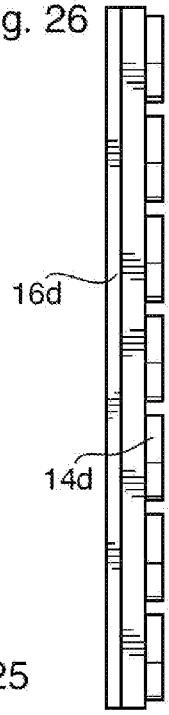
Fig. 26

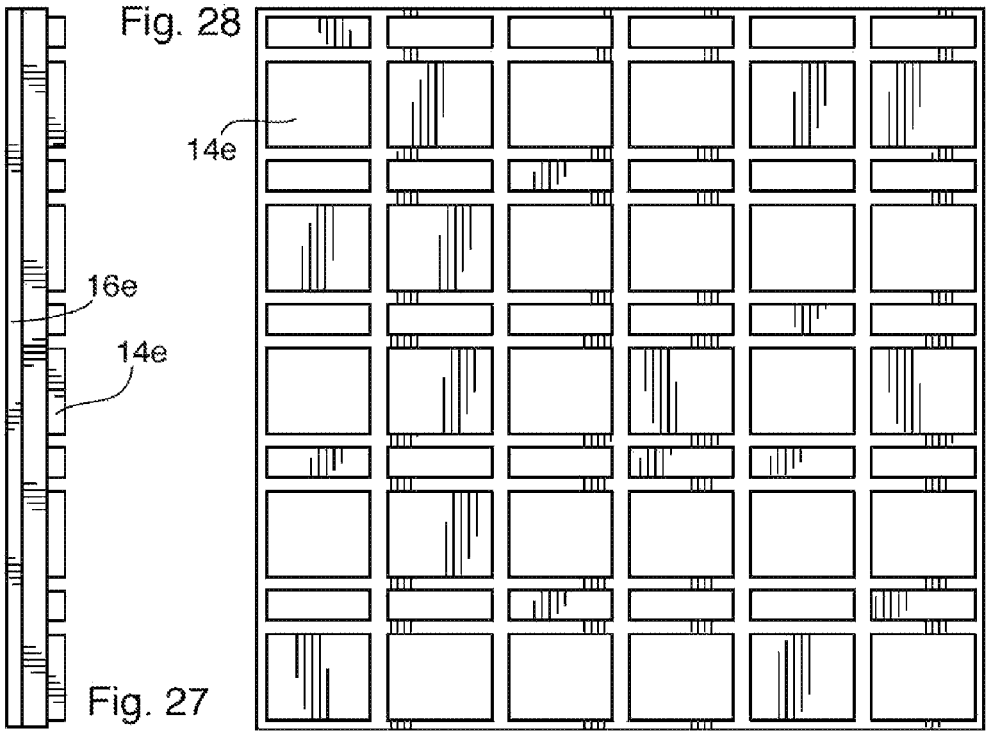
Fig. 28
Fig. 27
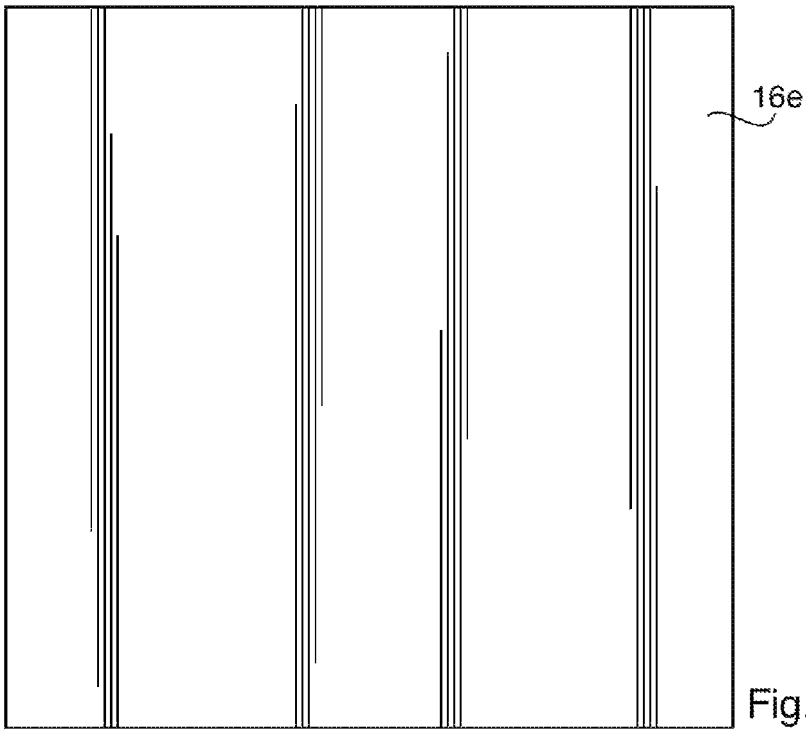
Fig. 29
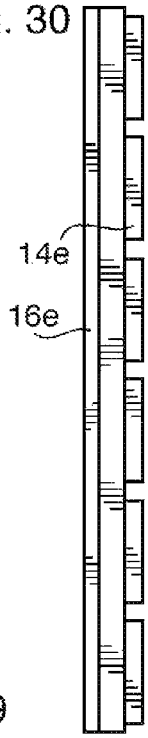
Fig. 30

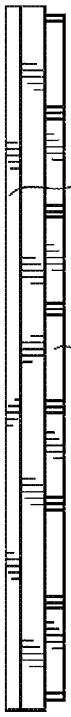
Fig. 31
Fig. 32
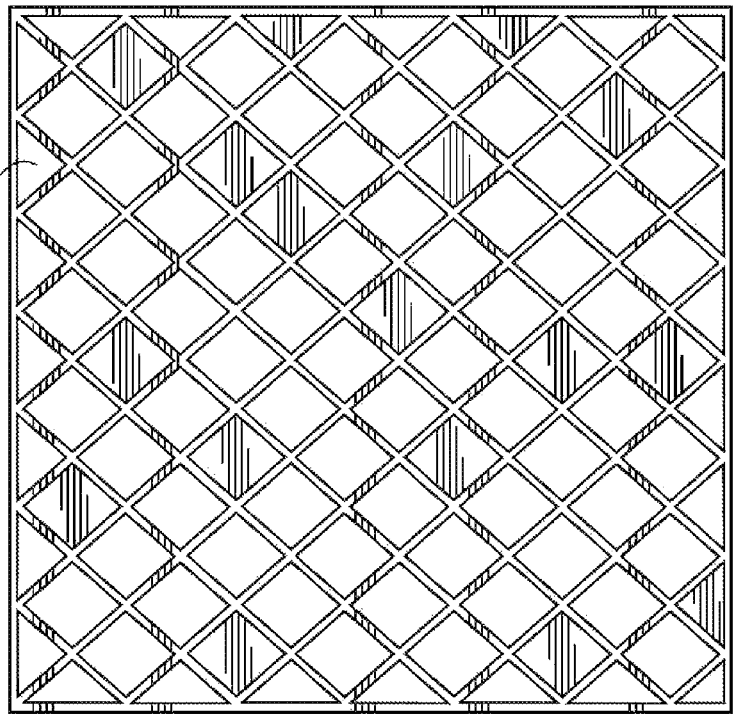
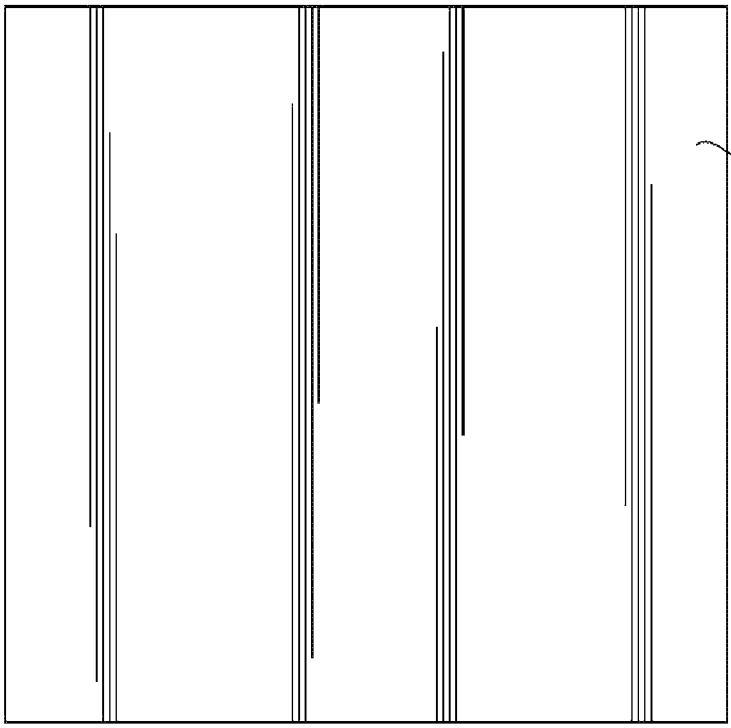
Fig. 33
Fig. 34
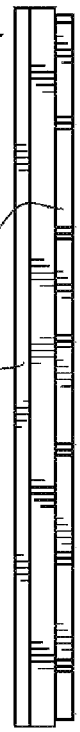

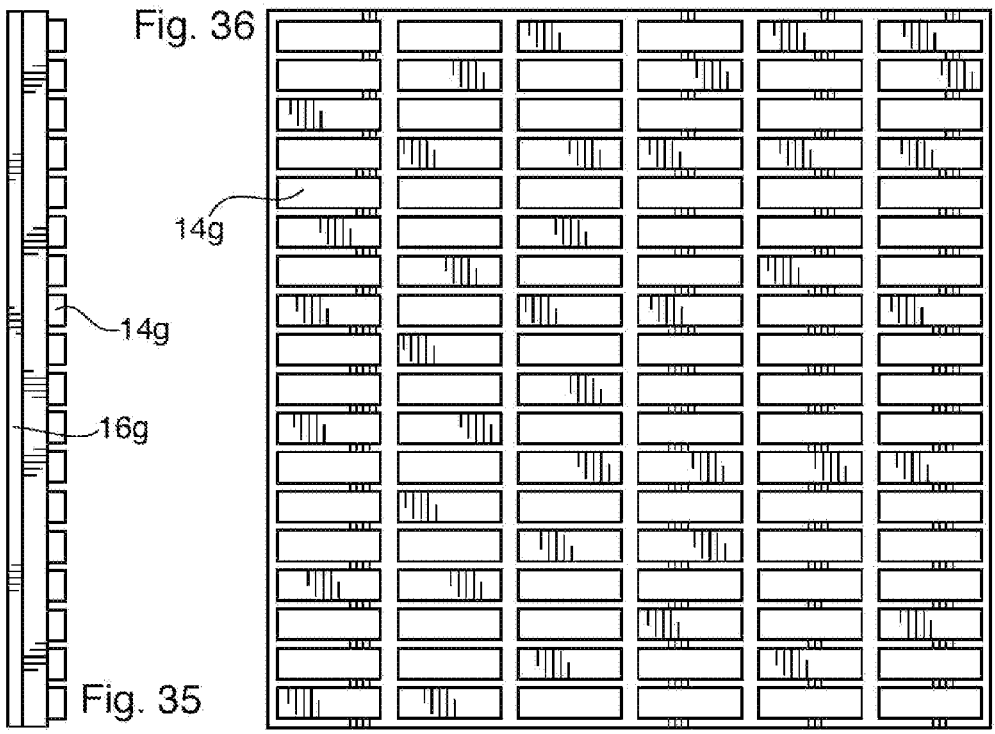
Fig. 36
Fig. 35
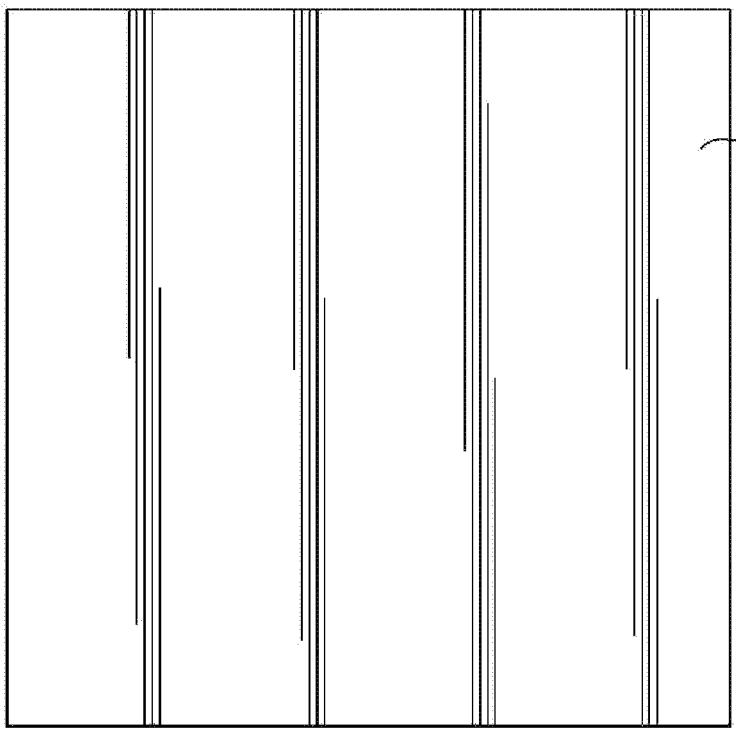
Fig. 37
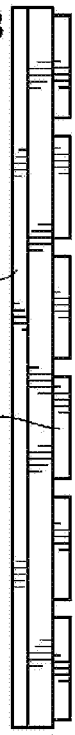
Fig. 38

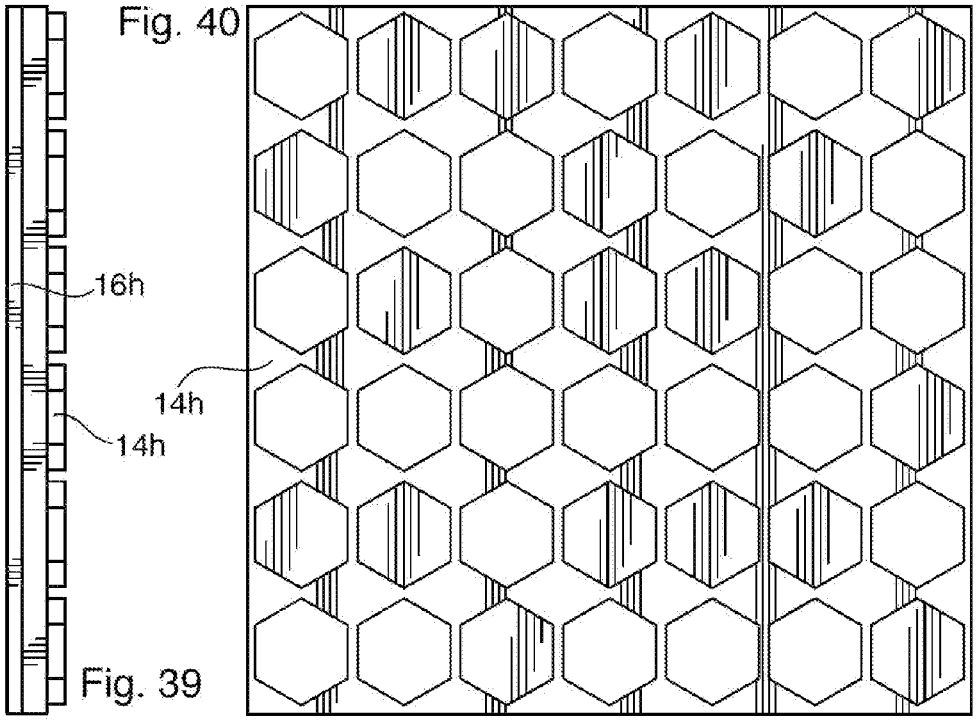
Fig. 40
Fig. 39
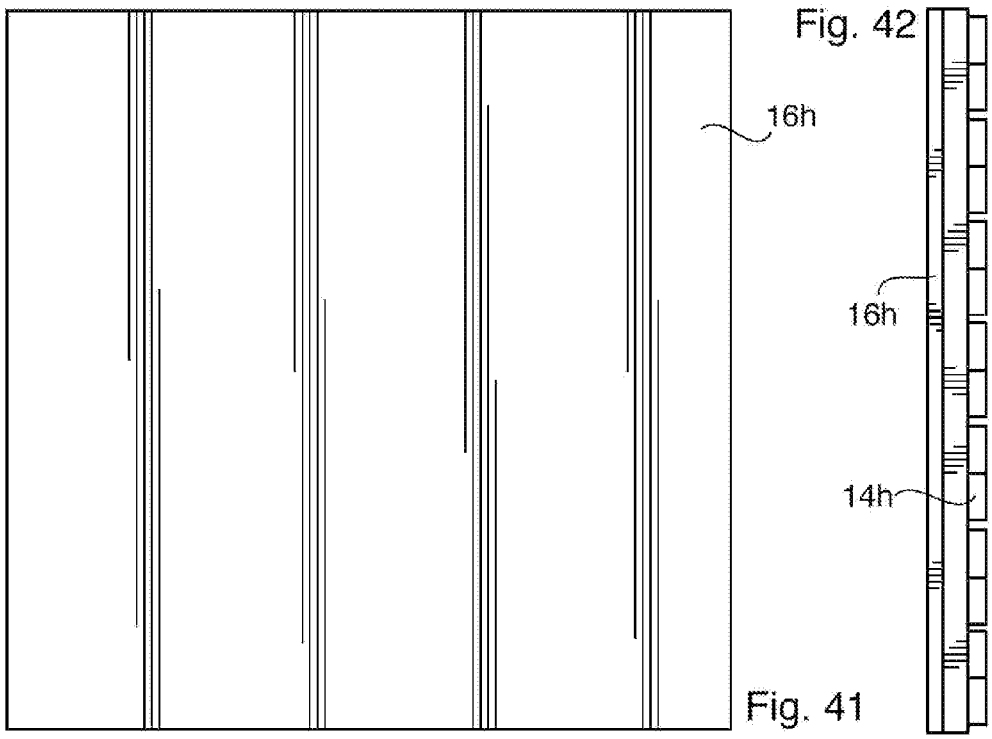
Fig. 42
Fig. 41

Fig.45
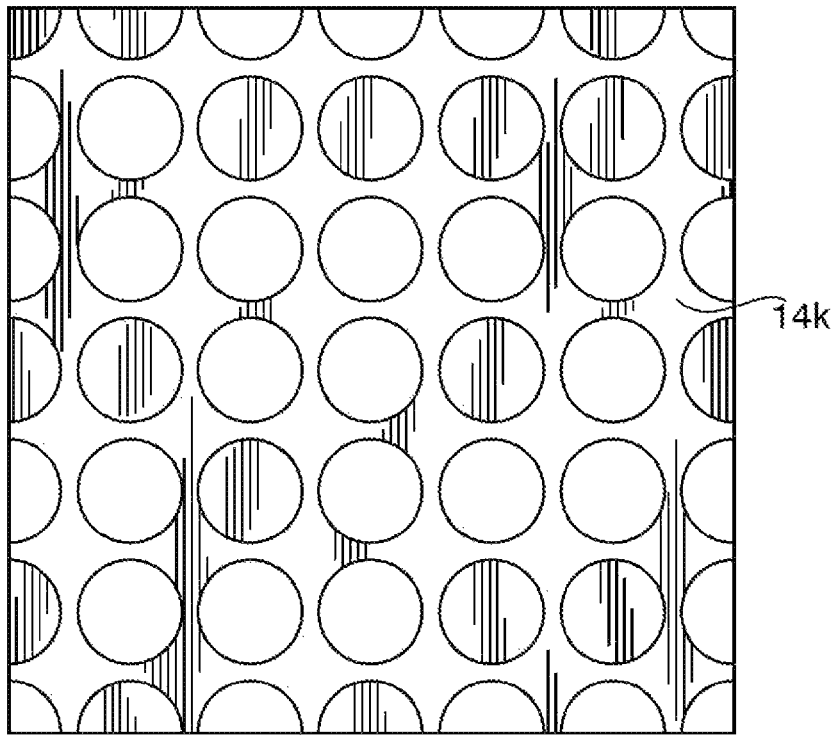
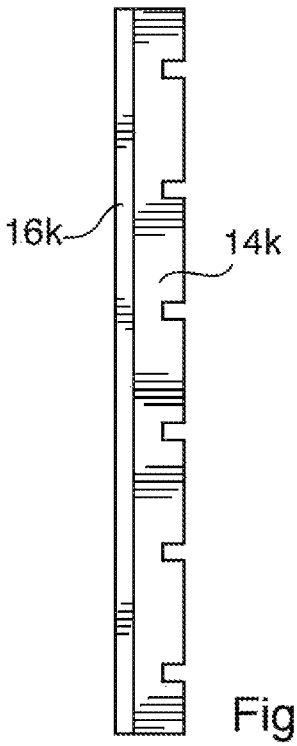
Fig.46
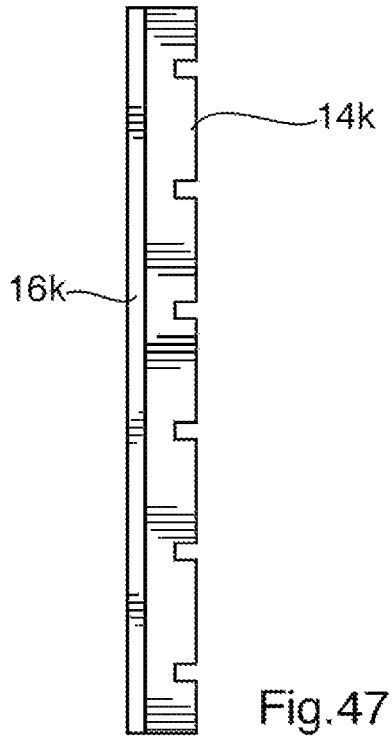
Fig.47

Fig.48
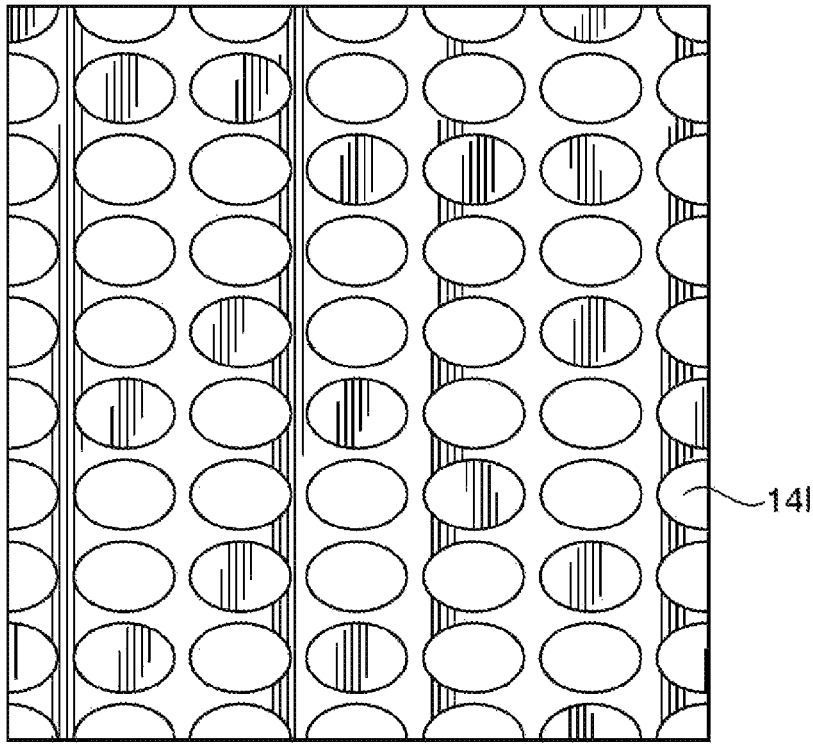
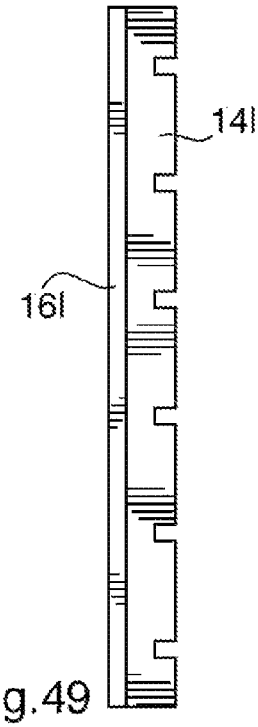
Fig.49
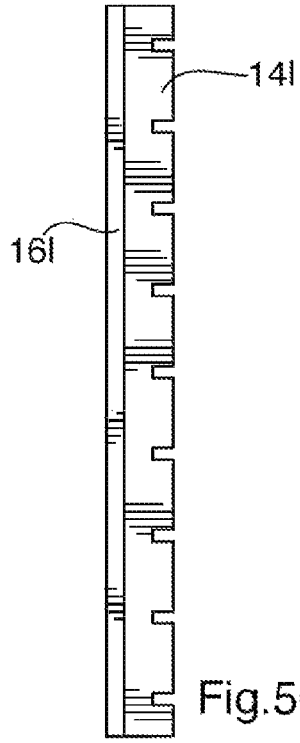
Fig.50

Fig.51
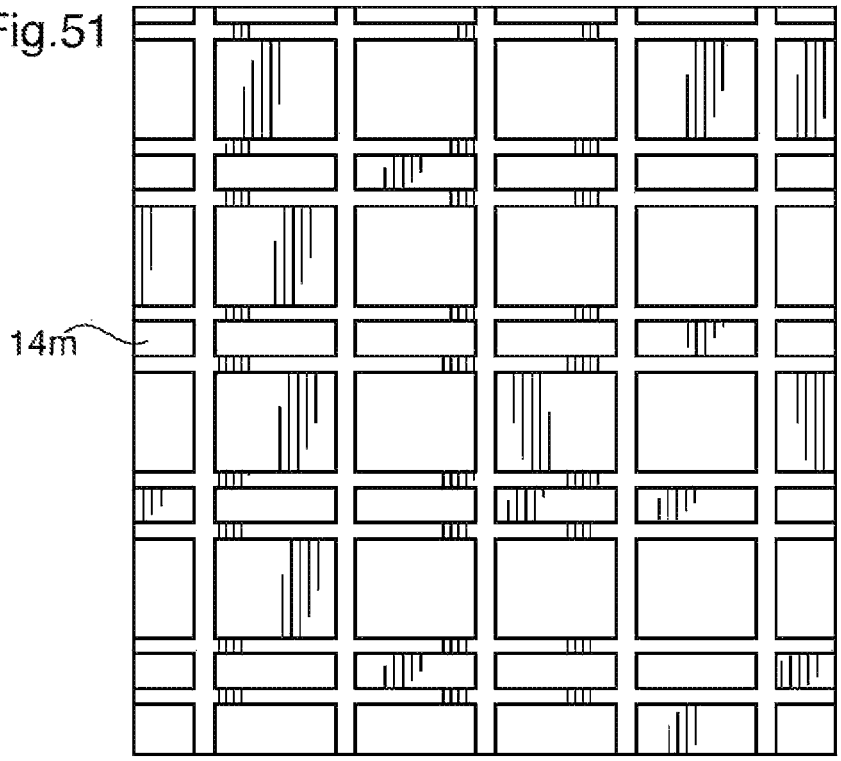
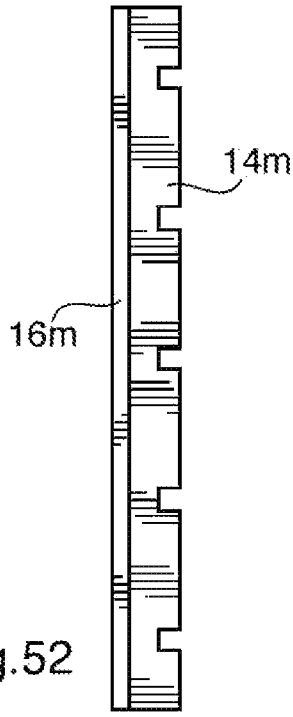
Fig.52
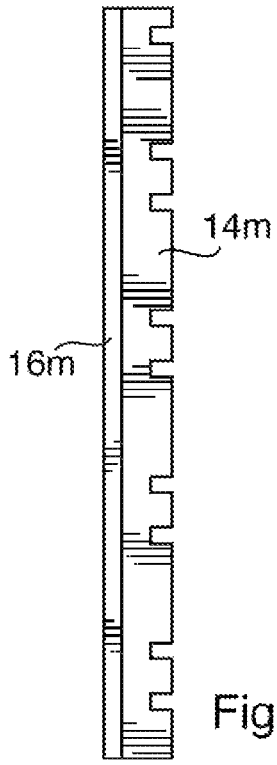
Fig.53

EXTERIOR WALL FINISHING ARRANGEMENT

FIELD OF THE INVENTION

The following is directed in general to building construction and more particularly to a finishing arrangement for an exterior wall of a building.

BACKGROUND OF THE INVENTION

Framing construction of buildings is a well-known technique involving the building of frames for wall and floors using stable structural members such as wooden studs to form frames, to which sheathing and typically insulation are then applied. Other types of building construction techniques include concrete wall construction, construction using structural insulating panels, and several others. The interior walls of a building may be finished with drywall or plaster, appropriately treated, and painted or wallpapered. The exterior walls of the building can also be finished in various ways, but with most techniques it is common to first apply a thin weather or water barrier of plastic, foil, or other material having low water permeability against the exterior of the wall, the outer layer of which may be of plywood, pressboard, chipboard, oriented strand board (OSB), or other materials. Such a weather or water barrier tends to block or significantly retard the ingress of moisture due to rain, dew and other environmental phenomena towards the interior of the building, thereby to guard against moisture damage and discourage the growth of mold within the wall itself, for example.

With frame construction, it is known to insert fiberglass insulation between the studs against the exterior sheathing in order to insulate the walls and thereby retain desirably heated or cooled air within the building. However, with frame construction and other techniques for building, improved arrangements with increased insulation value are desirable, particularly in climates having periods of very cold or very hot weather, to improve the building's capacity for retaining desired temperatures within the building.

SUMMARY OF THE INVENTION

In accordance with an aspect of the present invention, there is provided a finishing arrangement for an exterior wall of a building, comprising a weather or water barrier against at least the exterior of the wall; an outer hardboard panel; an insulating foam panel between the weather or water barrier and the outer hardboard panel, the insulating foam panel attached to the outer hardboard panel and having drainage channels therein; and a drainage guide that extends from the weather or water barrier to at least the outer hardboard panel, for guiding moisture away from the wall.

Provision of the insulating foam panel improves the insulating properties of the wall. However, it has been recognized that simply affixing an insulating foam panel directly against a weather or water barrier can tend to create situations in which moisture can enter between the weather or water barrier and the foam panel, and consequently become trapped against the weather or water barrier when it reaches the bottom of the foam panel. While typical weather or water barrier material exhibits very low permeability, if moisture is maintained against the weather or water barrier for very long, it can still slowly seep somewhat through the weather or water barrier and towards the interior of the building to rest against the exterior sheathing or make its way further towards the interior of the building. This can promote mold or rotting of the frames. Even if the amount of seepage is small, the standing moisture can cause problems with mold against the foam panel. As such, the finishing arrangement disclosed herein, in addition to providing increased insulation properties to the wall, also includes drainage features that provide guidance of moisture away from the wall that would otherwise become trapped at the weather or water barrier towards the bottom of the insulating foam panel.

In an embodiment, the insulating foam panel comprises drainage channels running horizontally and vertically along a surface thereof that faces the weather or water barrier. In another embodiment, the drainage channels run diagonally, or only vertically. The drainage channels are open to the weather or water barrier and provide a place for moisture that would otherwise stand against the weather or water barrier to flow away from the weather or water barrier, so as not to remain against the weather or water barrier and to be guided away from the wall.

In an embodiment, at least one support member is provided for at least partly supporting the weight of at least the insulating foam panel and the outer hardboard panel above the drainage guide.

In an embodiment, the support member and the drainage guide are a unitary structure. Alternatively, the support member and drainage guide are separate units that cooperate when brought together.

However, in the event that the foam panel and outer hardboard panel do not require additional support due their being light weight, then the support member would not be required.

These together with other aspects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

A detailed description of the preferred embodiment is set forth in detail below, with reference to the following drawings, in which:

FIGS. 17 and 18 are end and front views, respectively, of the alternative foam insulating panel and outer hardboard panel combination of FIG. 16;

FIGS. 23 to 26 are end, front, back and side views of another alternative foam insulating panel and outer hardboard panel combination;

FIGS. 27 to 30 are end, front, back and side views of another alternative foam insulating panel and outer hardboard panel combination;

FIGS. 31 to 34 are end, front, back and side views of another alternative foam insulating panel and outer hardboard panel combination;

FIGS. 35 to 38 are end, front, back and side views of another alternative foam insulating panel and outer hardboard panel combination;

FIGS. 39 to 42 are end, front, back and side views of another alternative foam insulating panel and outer hardboard panel combination;

FIGS. 45 to 47 are front, end and side views of the alternative foam insulating panel and outer hardboard panel combination of FIG. 44;

FIGS. 48 to 50 are front, end and side views of another alternative foam insulating panel and outer hardboard panel combination;

FIGS. 51 to 53 are front, end and side views of another alternative foam insulating panel and outer hardboard panel combination;

DETAILED DESCRIPTION

Figure 1:
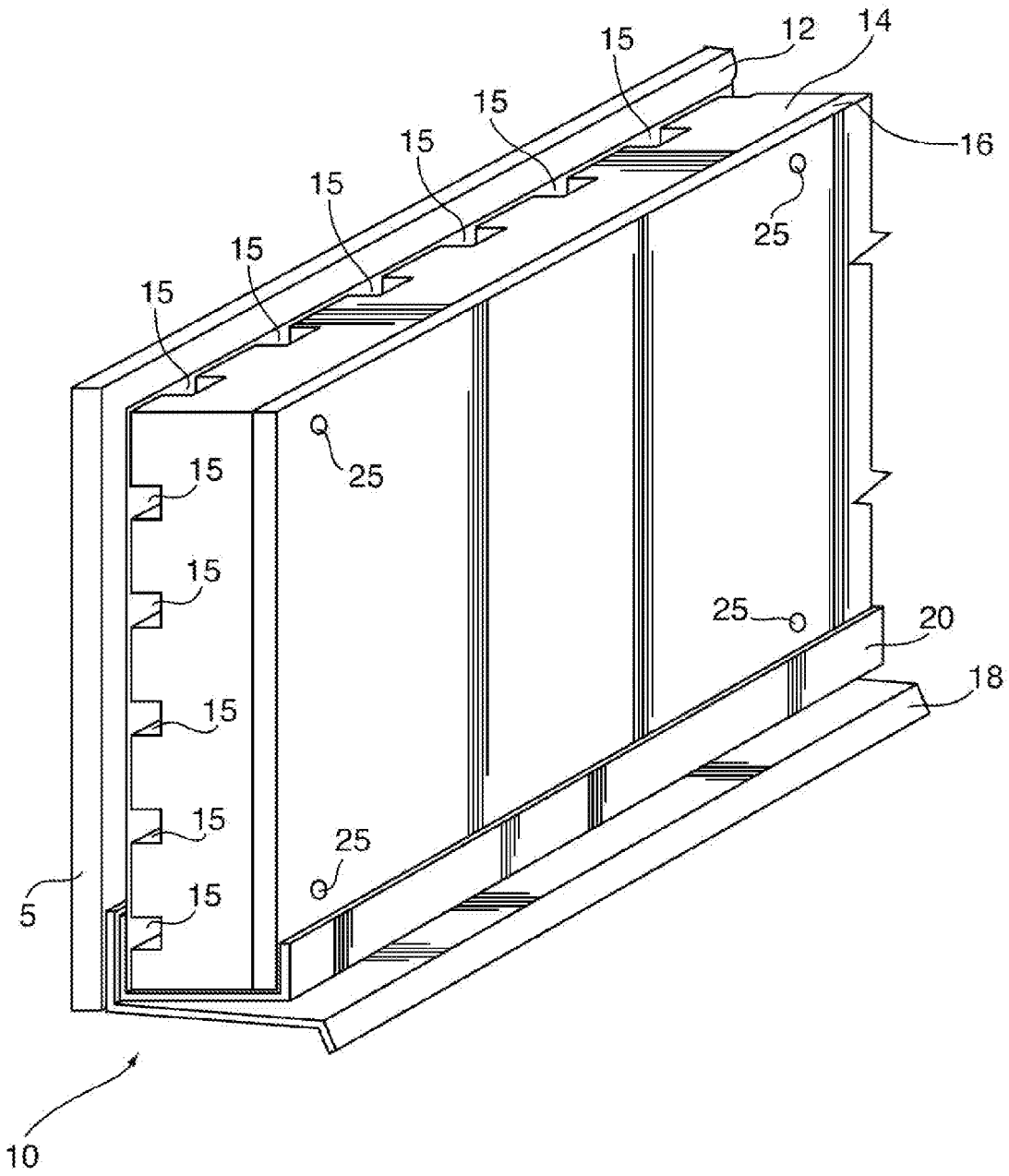
FIG. 1 is a perspective view of an exterior wall finishing arrangement according to an embodiment.

In FIG. 1, a finishing arrangement for an exterior wall is shown and generally identified with reference number 10. Finishing arrangement 10 is fastened to the exterior of the wall using screws 25, and comprises a weather or water barrier 12, an insulating foam panel 14, an outer hardboard panel 16, and a drainage guide 18. Finishing arrangement 10 is illustrated in FIG. 1 as comprising a single sheet of weather or water barrier 12, and a single piece of insulating foam panel 14 and outer hardboard panel 16. However, it is within the scope of the present disclosure to contemplate alternative configurations. For example, a single sheet of weather or water barrier 12 may be combined with multiple panels 14, 16 to form an arrangement 10, or multiple sheets of weather or water barrier 12 may be overlapped and combined with single ones of panels 14, 16 or multiple panels 14, 16 stacked on top of each other and/or positioned beside each other. In general, however, the particular configuration of arrangement 10 will depend on the particular wall configuration required, the chosen dimensions of the panels 14, 16, the builder's preference, and/or the builder's professional expertise applied to a particular construction situation.

In this embodiment, finishing arrangement 10 also comprises a support member 20, for supporting at least partially the weight of the foam panel 14 and the outer hardboard panel 16. It has been found that, where the foam and outer hardboard panels 14, 16 are thick, due to the weight particularly of the outer hardboard panel 16, and the softness of the foam panel 14, support underneath the panels 14, 16 can further assist to reduce any sagging or movement of panels 14, 16 away from exterior sheathing 5 or away from any other wall exterior that could be possible if just screws or other such fasteners alone were used. Support member 20, having a channel configuration, is affixed to the exterior of the wall prior to placement of panels 14, 16 within its channel. Where the foam and outer hardboard panels 14, 16 used are thinner and accordingly lighter, a support member 20 may not be required. For example, where foam panel 14 is one inch or less in thickness, typically a support member is not required.

In this embodiment, weather or water barrier 12 is a polyethylene sheet, available from rolls of polyethylene material in varying lengths and widths. Other materials for weather or water barrier 12, such as plastic film or mesh foil, may be utilized as desired.

In this embodiment, insulating foam panel 14 is molded from expandable polystyrene (EPS) in a known manner, and includes drainage channels 15 formed in a surface of the foam panel 14 that faces the weather or water barrier 12. Due to this configuration, moisture against the weather or water barrier 14 can flow down and away from the weather or water barrier 12 and into the drainage channels 15, and thereby not remain against the weather or water barrier 12.

In this embodiment, outer hardboard panel 16 is of fibercement board, but can be formed of other materials, such as cement board, metal sheeting or magnesium oxide board. In the case of metal sheeting, aluminum or stainless steel are contemplated, and each may be pre-painted prior to assembly of the finishing arrangement. The fiber cement board or magnesium oxide board may be pre-painted also, and the cement board may be either pre-painted or coated with stucco for texture prior to and/or after assembly of the finishing arrangement.

In this embodiment, drainage guide 18 is formed of sheet metal, typical for use in making flashing during construction, and support member 20 is formed of a more rigid material, such as hard steel, so as not to buckle when under the weight of the panels 14, 16. Alternative materials may include plastic or aluminum.

The weather or water barrier 12 lies generally against the exterior of the wall, and is generally cut larger than the foam panel 14 and can extend somewhat past the exterior sheathing 5 as desired during construction. The insulating foam panel 14 is positioned between the weather or water barrier and the outer hardboard panel, and the drainage guide 18 extends from the weather or water barrier 12 to the outer hardboard panel. In this embodiment, the drainage guide 18 extends beyond the outer hardboard panel. However, in other embodiments, the drainage guide 18 extends just to about the outer hardboard panel but not beyond. The drainage guide 18 extends underneath each of the weather or water barrier 12, the insulating foam panel 14 and the outer hardboard panel 16, and can receive moisture flowing downward from the panels 14, 16 or the weather or water barrier 12 onto the drainage guide 18 and guide the moisture away from the wall.

Figure 2:
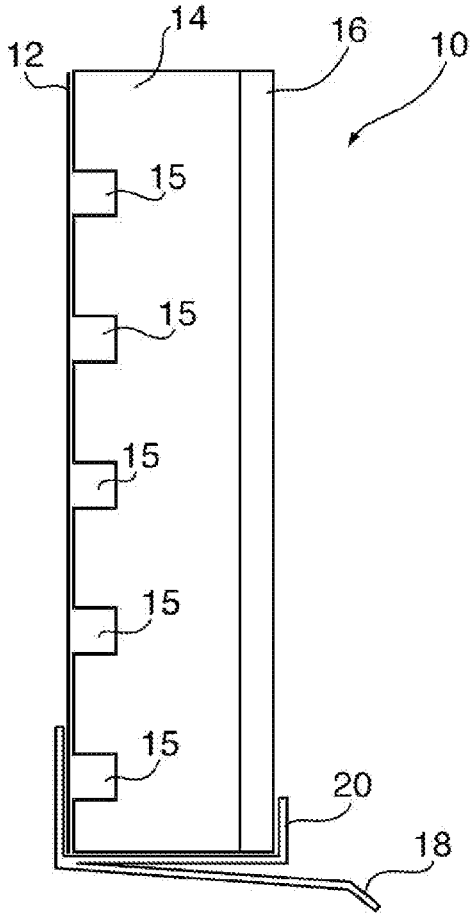
FIG. 2 is an end view of the exterior wall finishing arrangement of FIG. 1.

FIG. 2 is a side view of the arrangement 10. It can be seen that the drainage guide 18 is angled downwards with respect to the panels 14, 16 and the support member 20, to provide a downward path on which moisture can travel away from the wall. It can be seen that, in this embodiment, the drainage guide extends a small distance past the outer hardboard panel 16 so that moisture exiting the wall is deposited away from the wall itself, and that at its rightmost end there is a sharp downturn to promote dropping of the moisture. Also, the leftmost end of the drainage guide 18, as seen in FIG. 2, extends upwards against the weather or water barrier 12. In general, the drainage guide 18 in this embodiment has a Z-profile.

Figure 3:
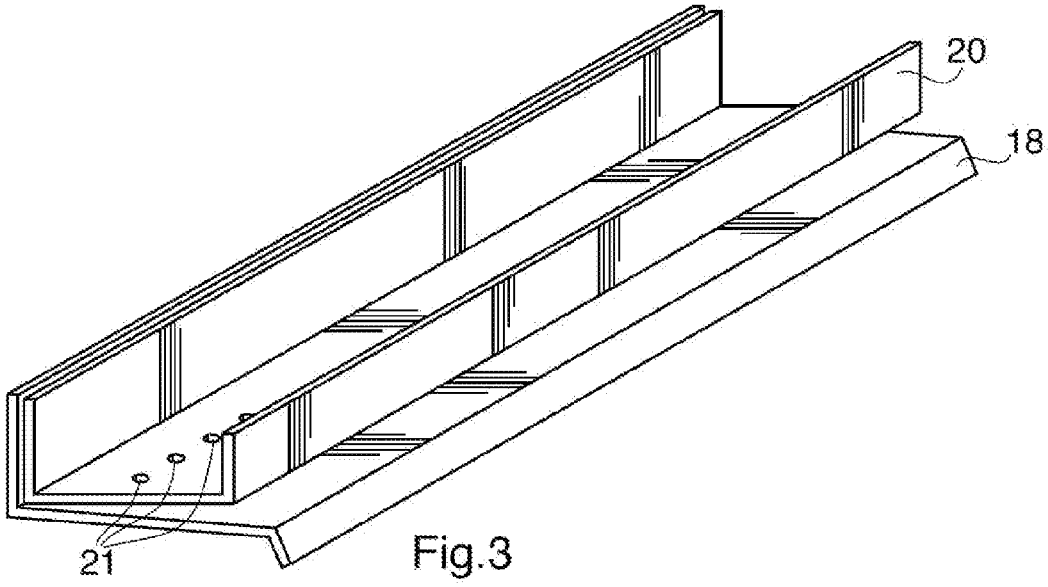
FIG. 3 is a perspective view of a drainage guide and support member of the exterior wall finishing arrangement of FIG. 1, in isolation.

FIG. 3 is a perspective view of the drainage guide 18 and the support member 20 of the exterior wall finishing arrangement 10 of FIG. 1, in isolation. From this view it can be seen that support member 20 extends along the length of the panels 14, 16, and includes in the bottom of its channel portion a series of holes 21 through the bottom of its channel. The holes 21 permit moisture running down channels 15 in panels 14, 16 and into the support member 20 to drop through the holes 21 to the drainage guide 18 below, so the moisture can be guided away from the wall.

Figure 4:
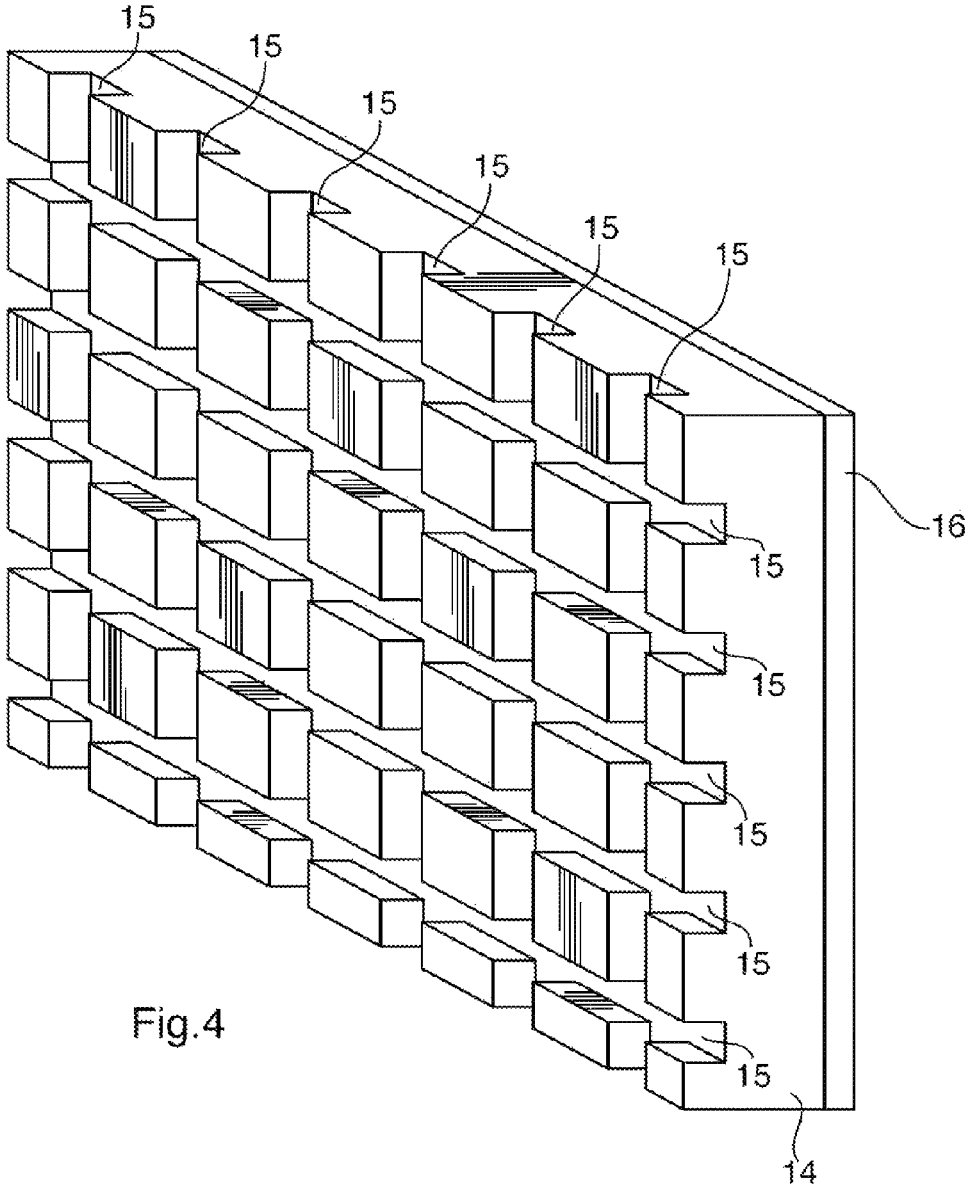
FIG. 4 is a perspective view of a foam insulating panel and outer hardboard panel of the exterior wall finishing arrangement of FIG. 1, with channels in a surface of the foam insulating panel.

FIG. 4 is a perspective view, from a different angle, of the foam panel 14 and outer hardboard panel 16, in isolation. In this embodiment, the foam panel 14 and the outer hardboard panel 16 are attached together with glue, and can thus be manipulated as a single unit. Also in this embodiment, the horizontal and vertical drainage channels 15 extend the entire length and also the width of the foam panel 15 and are open at the ends to permit moisture to flow within the channels and downwards towards the drainage guide 18 to be guided away from the wall.

The drainage channels 15 are formed during molding of the insulating foam panel 14, or may be formed in a hot or cold cutting process after molding.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact operation illustrated and described, and accordingly all suitable modifications and equivalents may be resorted to, falling within the purpose and scope of the invention.

Figure 5:
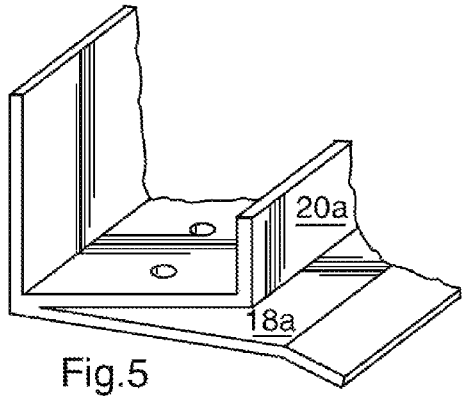
FIG. 5 is an end perspective view of part of an alternative drainage guide and support member as a unitary structure.

For example, while the support member 20 and drainage guide 18 have been described and shown as separate units, alternatively the support member 20 and drainage guide 18 could be a unitary structure. Turning to FIG. 5, there is shown an end view example of such a unitary support member 20 and drainage guide 18. The support member 20 may be welded to the drainage guide 18 prior to delivery to the building site, or cast or molded as a single structure.

Figure 6:
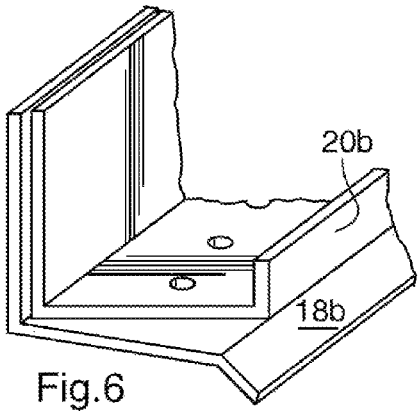
FIG. 6 is an end perspective view of part of an alternative drainage guide and support member.

FIG. 6 is an end perspective view of part of an alternative drainage guide 18*b* and support member 20*b*. Like the embodiment shown in FIG. 3, the alternative drainage guide and support member 18*b*, 20*b* do not share a single upward-extending face that extends behind the weather or water barrier as does the embodiment shown in FIG. 5. However, in this embodiment the drainage guide 18*b* does not extend beyond the support member, the end of which corresponds to the outer hardboard panel. Rather, the drainage guide extends just to the outer hardboard panel. The opposite ends of each of the alternative support member 20*b* and the alternative drainage guide 18*b* each extend behind the weather or water barrier, however. It will be understood that the non-unitary drainage guide 18*b* and support member 20*b* may be manufactured separately and then affixed to each other prior to delivery to a construction site, or maintained as separate parts until the point of installation.

Figure 7:
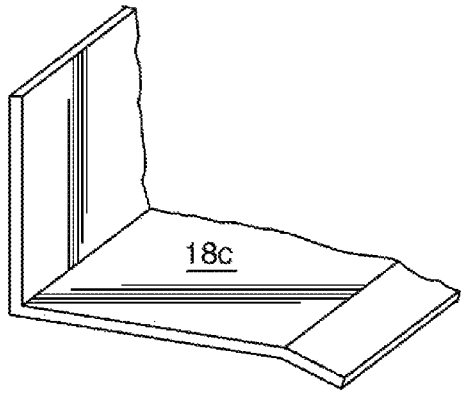
FIG. 7 is an end perspective view of part of an alternative drainage guide.

FIG. 7 is an end perspective view of part of an alternative drainage guide 18*c* without a support member. As described above, in the event that the weight of the insulating foam panel 14 and the outer hardboard panel 16 does not require additional support, a support member may not be required.

Figure 8:
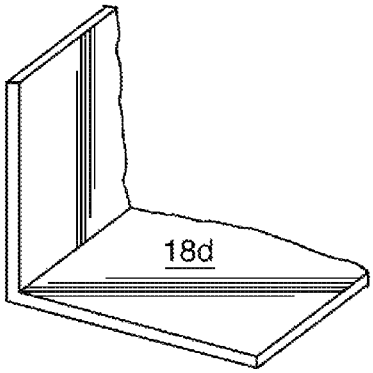
FIG. 8 is an end perspective view of part of another alternative drainage guide.

While the drainage guide 18 has been described above as having generally a Z-profile, other configurations are possible. For example, while the sharp downturn of the drainage guide 18 at its rightmost end causes moisture reaching that position to travel faster downwards to make it more likely that it will fall off of the drainage guide 18 at that point, depending upon the downward angle at the midpoint of the drainage guide 18, the sharp downturn may not be provided. FIG. 8 is an end perspective view of part of another alternative drainage guide 18*d*, wherein there is no additional downturn at the end of the alternative drainage guide.

Figure 9:
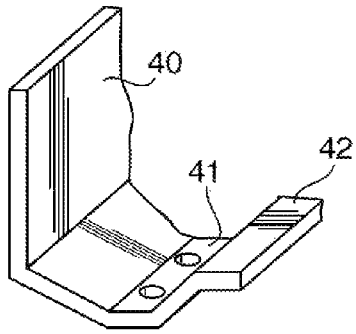
FIG. 9 is an end perspective view of part of another alternative drainage guide and support member as a unitary structure.

FIG. 9 is an end perspective view of part of another alternative drainage guide and support member as a unitary structure 40. Unitary structure 40 is formed as generally a U-shaped channel with holes in the bottom 41 for guiding moisture away from the wall, and an upturn for providing a surface 42 on which an insulating foam panel and outer hardboard panel combination can be supported.

Figure 10:
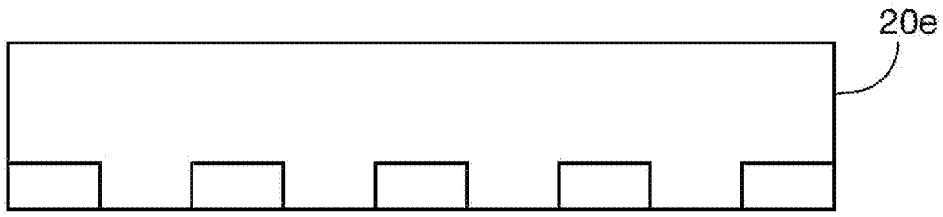
FIG. 10 is a front elevation view of an alternative support member.
Figure 11:
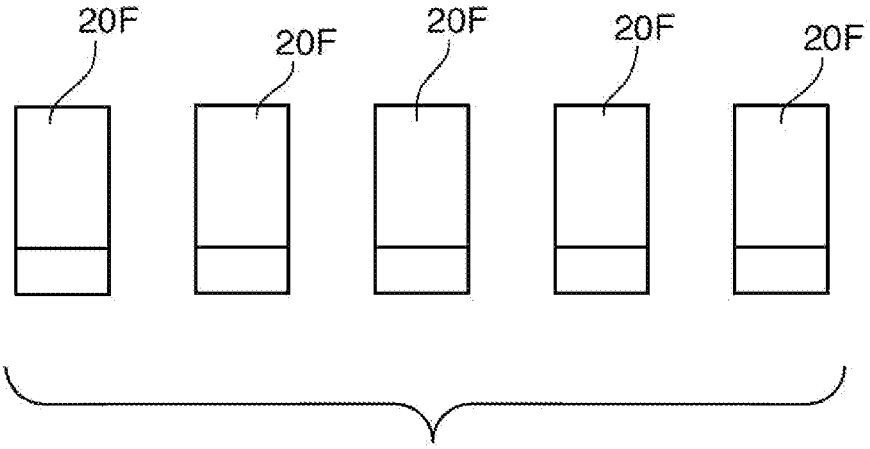
FIG. 11 is a front elevation view of a set of different alternative support members.

While support member 20 has been described as a channel extending the entire length of the panels 14, 16, other configurations are possible. For example, as shown in FIG. 10, a support member 20*a* is shown from the front, and includes a single backplane supporting several spaced-apart channels. In this embodiment, there is less a need for holes 21, because the spaces between the channels are available to permit moisture to flow down to the drainage guide 18. Alternatively, several thinner individual support members 20*b* having respective channels could be used, as shown in FIG. 11.

While screws have been described as the fasteners for affixing the finishing arrangement to the exterior of the wall, other fasteners such as nails or spikes or other arrangements may be used.

Figure 12:
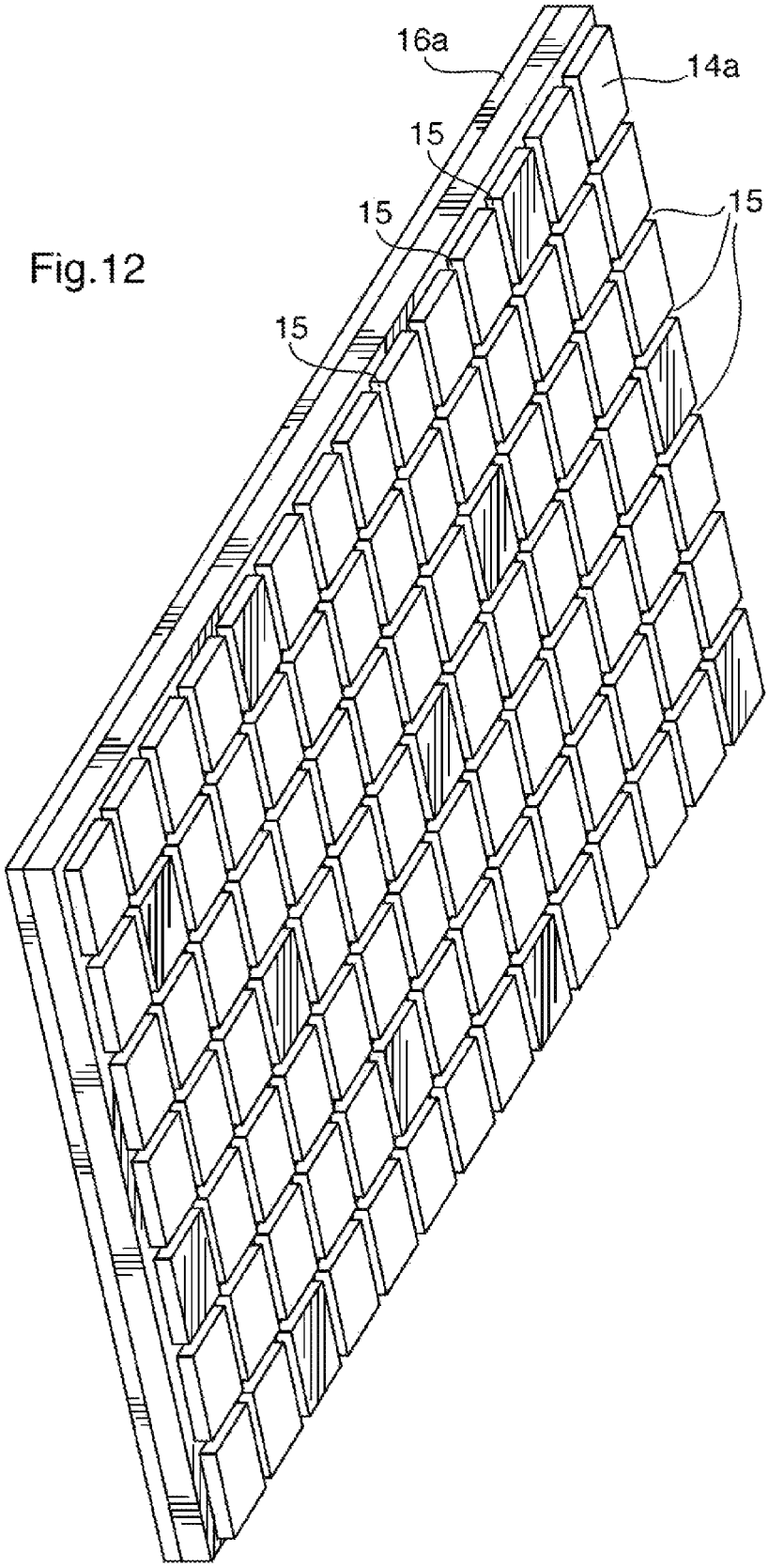
FIG. 12 is a perspective view of an alternative foam insulating panel and outer hardboard panel combination.
Figure 14:
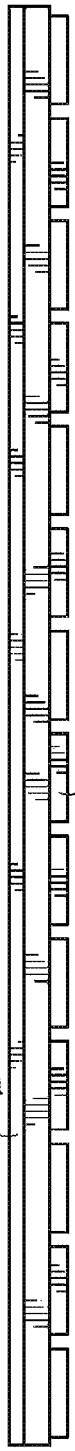
FIGS. 13 to 15 are end, side and front views, respectively, of the alternative foam insulating panel and outer hardboard panel combination of FIG. 12.
Figure 15:
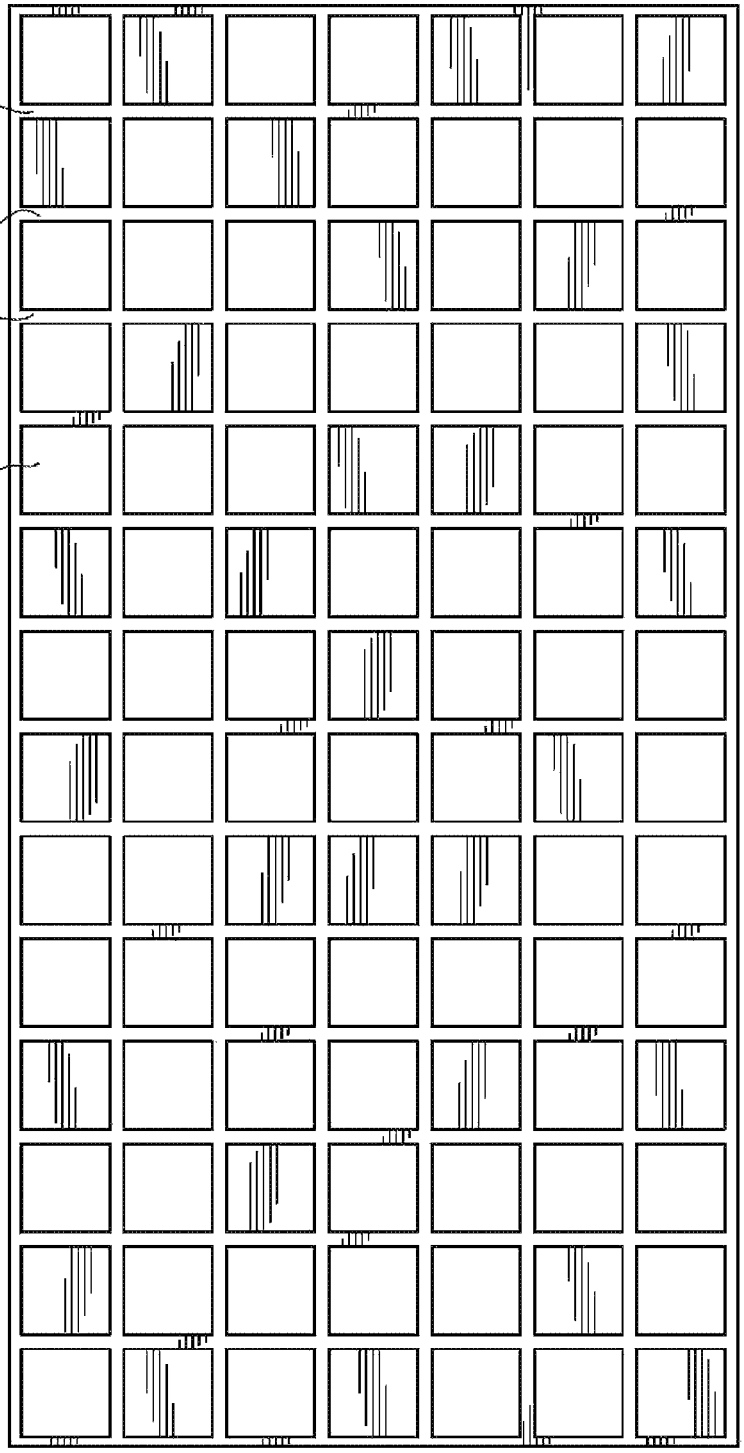
Figure 13:
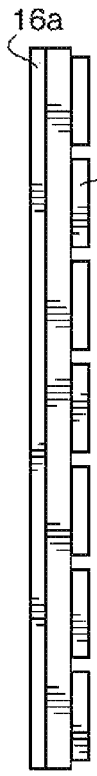

Alternative insulating foam panels are contemplated. For example, FIG. 12 is a perspective view of an alternative insulating foam panel 14*a* and an outer hardboard panel 16*a*, and FIGS. 13 to 15 are end, side and front views, respectively, of the alternative insulating foam panel 14*a* and outer hardboard panel 16*a* of FIG. 12. The embodiment of FIGS. 12 to 15 is similar to that shown in FIG. 4, but the insulating foam panel 14*a* is thinner than that shown in FIG. 4, and there are horizontal and vertical drainage channels 15 at the periphery of the insulating foam panel 14*a*.

For ease of understanding, in the following description of the present embodiment and of alternative embodiments, the drainage channels 15 may be described as being formed in the surface of the insulating foam panel causing shapes to be formed in the surface of the insulating foam panel, or the drainage channels 15 may be described as being as a consequence of shapes (such as squares as in the present embodiment) being formed in the surface of the insulating foam panel. Whether drainage channels 15 are described as being a consequence of shape formation, or the shapes are described as being a consequence of drainage channel formation, the resulting structure of the insulating foam panel is intended to be the same.

Returning to FIGS. 12 to 15, squares in the surface of the insulating foam panel 14*a* facing the weather or water barrier do not extend all of the way to the edge of the insulating foam panel 14*a*, thereby leaving room for horizontal and vertical drainage channels 15 at the periphery of the insulating foam panel 14*a*, which is at the interface between the foam panel 14*a* and an adjacent foam panel (not shown). For ease of understanding in this and the following figures, only a few drainage channels 15 have been identified with reference numerals.

Figure 16:
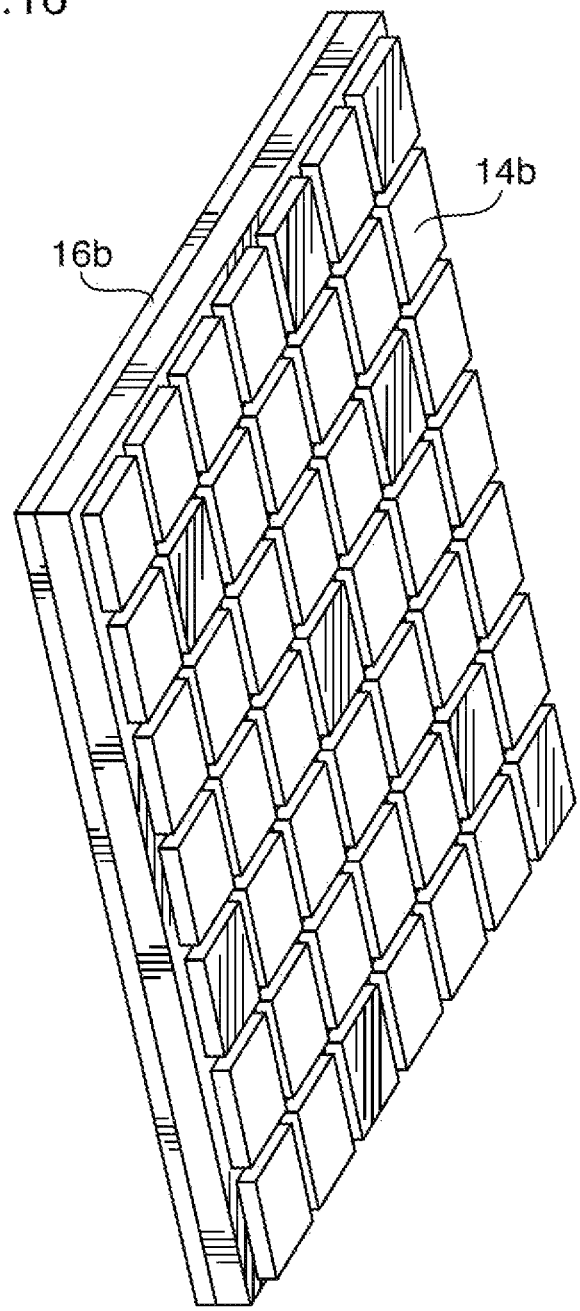
FIG. 16 is a perspective view of another alternative foam insulating panel and outer hardboard panel combination.
Figure 19:
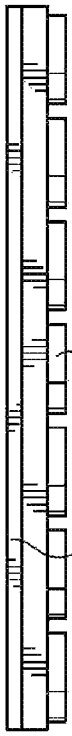
FIGS. 19 to 22 are end, front, back and side views of another alternative foam insulating panel and outer hardboard panel combination.
Figure 20:
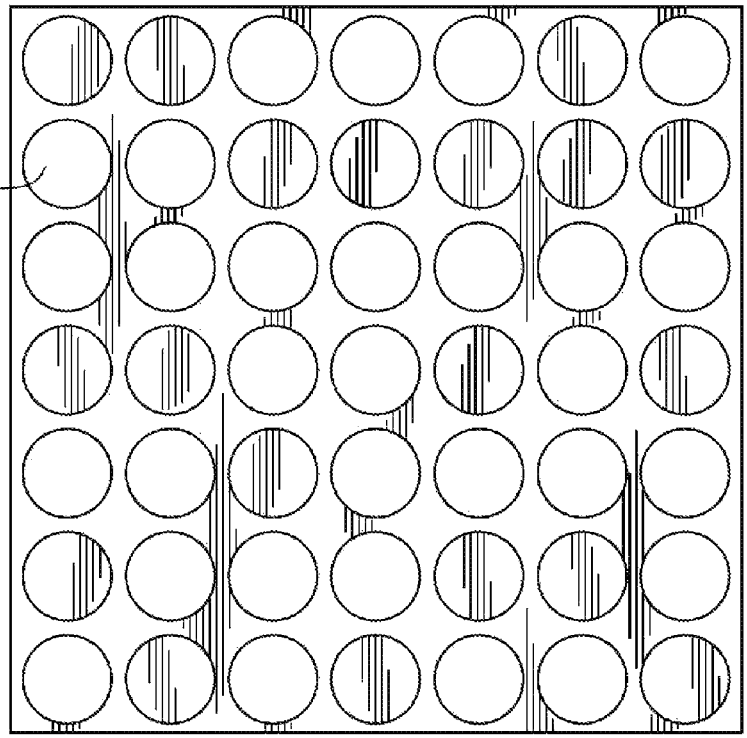
Figure 21:
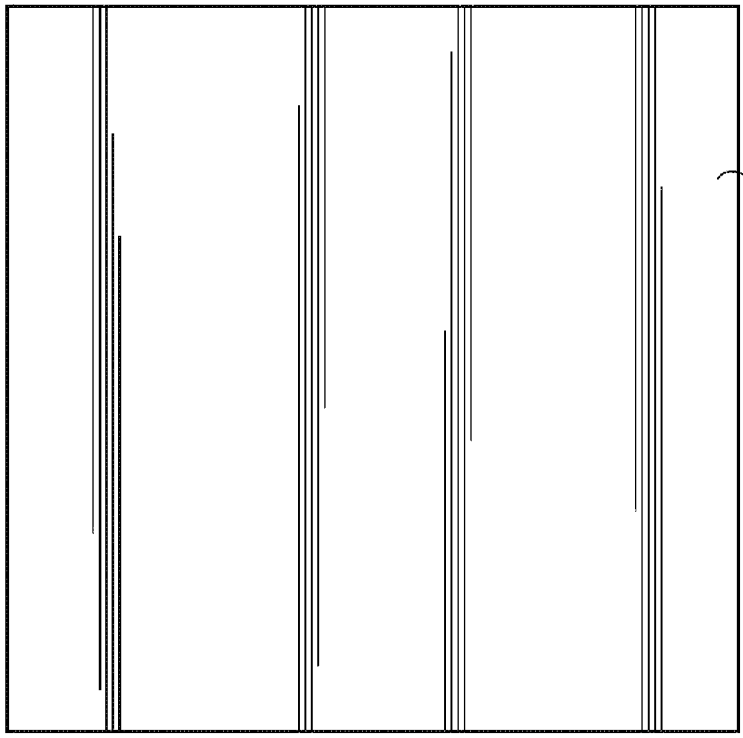
Figure 22:
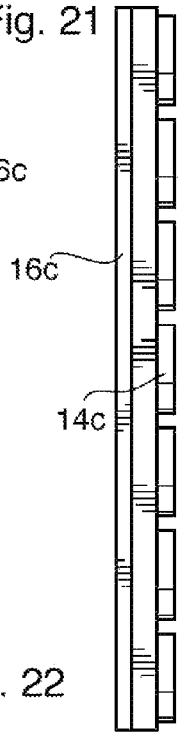

FIG. 16 is a perspective view of another alternative foam insulating panel 14*b* with outer hardboard panel 16*b*, and FIGS. 17 and 18 are end and front views, respectively, of the alternative foam insulating panel 14*b* and outer hardboard panel 16*b* of FIG. 16. The embodiment of FIGS. 16 to 18 is similar to that shown in FIGS. 12 to 15, but the insulating foam panel 14*b* and outer hardboard panel 16*b* is wholly formed as a square rather than as a rectangle.

FIGS. 19 to 22 are end, front, back and side views of another alternative insulating foam panel 14*c* and outer hardboard panel 16*c*. In this embodiment, circles (or, strictly, cylinders or pedestals but described herein as circles for ease of understanding) formed in the surface facing the weather or water barrier create drainage channels 15 between the circles that are not linear. Furthermore, due to the non-linear surfaces of the circles themselves, moisture flowing downwards and reaching the tops of the circles will tend to flow down the circles, rather than remain on a flat shelf as may be the case with the embodiments described above, since with such circles there is no flat surface for the moisture to remain upon.

FIGS. 23 to 26 are end, front, back and side views of another alternative insulating foam panel 14*d* and outer hardboard panel 16*d*. This embodiment is similar to that shown in FIGS. 19 to 22, except that instead of circles, ellipses are formed in the surface of the insulating foam panel 14*d* that faces the weather or water barrier and the drainage channels 15 are accordingly formed between the ellipses.

FIGS. 27 to 30 are end, front, back and side views of another alternative insulating foam panel 14*e* and outer hardboard panel 16*e*. This embodiment is similar to that shown in FIGS. 16 through 18, except that rectangles of different sizes are formed in the surface of the insulating foam panel 14*e* that faces the weather or water barrier and the drainage channels 15 are accordingly formed between the different size rectangles.

FIGS. 31 to 34 are end, front, back and side views of another alternative insulating foam panel 14*f* and outer hardboard panel 16*f*. In this embodiment, diamonds are formed in the surface of the insulating foam panel 14*f* that faces the weather or water barrier and the drainage channels 15 are accordingly formed on diagonals between the diamonds.

FIGS. 35 to 38 are end, front, back and side views of another alternative insulating foam panel 14*g* and outer hardboard panel 16*g*. This embodiment is similar to that shown in FIGS. 16 through 18, except that thin rectangles of the same size are formed in the surface of the insulating foam panel 14*g* that faces the weather or water barrier and the drainage channels 15 are accordingly formed between the same sized rectangles.

FIGS. 39 to 42 are end, front, back and side views of another alternative insulating foam panel 14*h* and outer hardboard panel 16*h*. In this embodiment, hexagons are formed in the surface of the insulating foam panel 14*h* that faces the weather or water barrier and the drainage channels 15 are accordingly formed between the hexagons.

Figure 43:
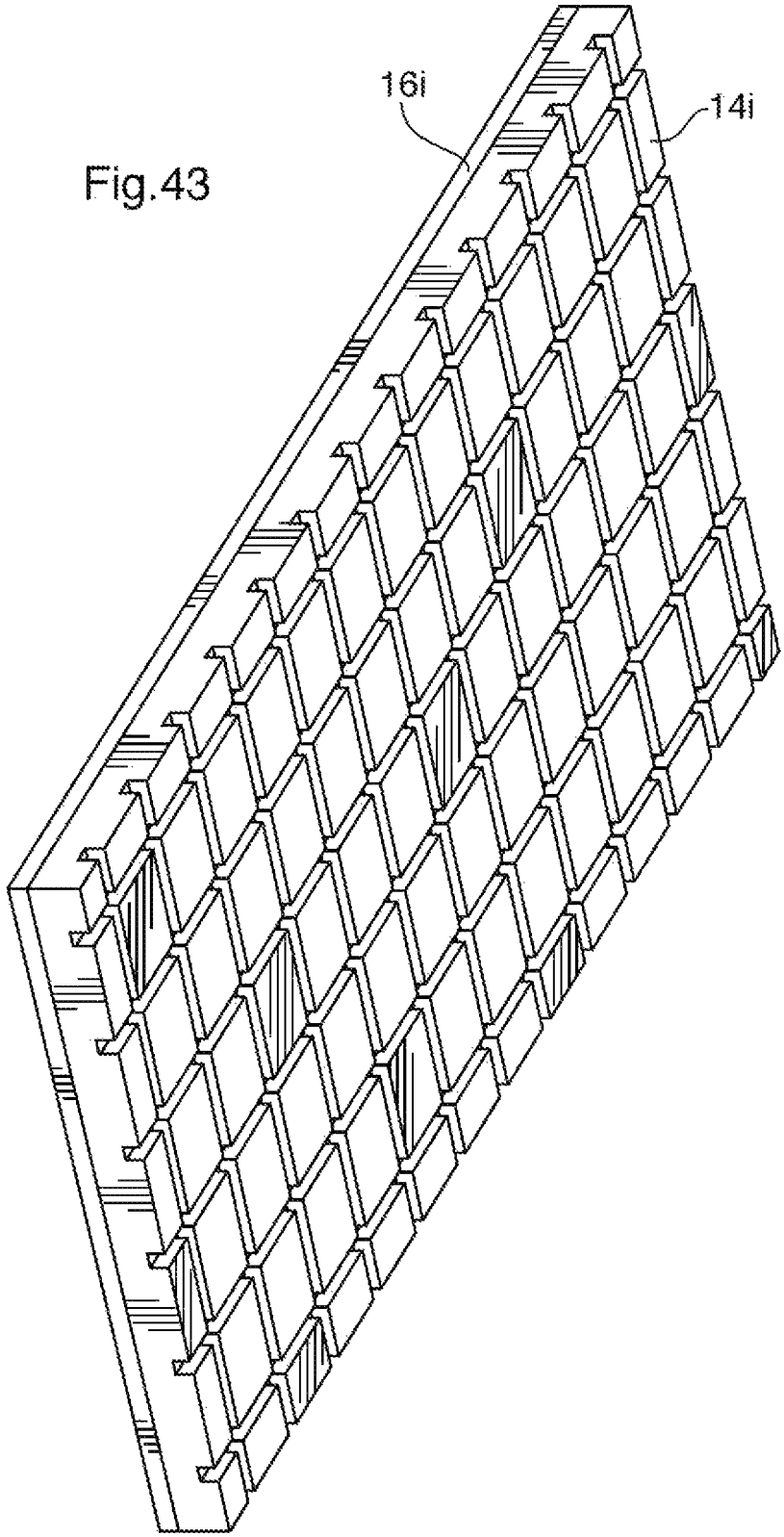
FIG. 43 is a perspective view of another alternative foam insulating panel and outer hardboard panel combination.

FIG. 43 is a perspective view of another alternative insulating foam panel 14*i* and outer hardboard panel 16*i*. This embodiment is similar to the embodiment shown in FIG. 4, but the insulating foam panel 14*i* is thinner. Accordingly, due to the thinner insulating foam panel 14*i*, the use of a support member as has been described above may not be required.

Figure 44:
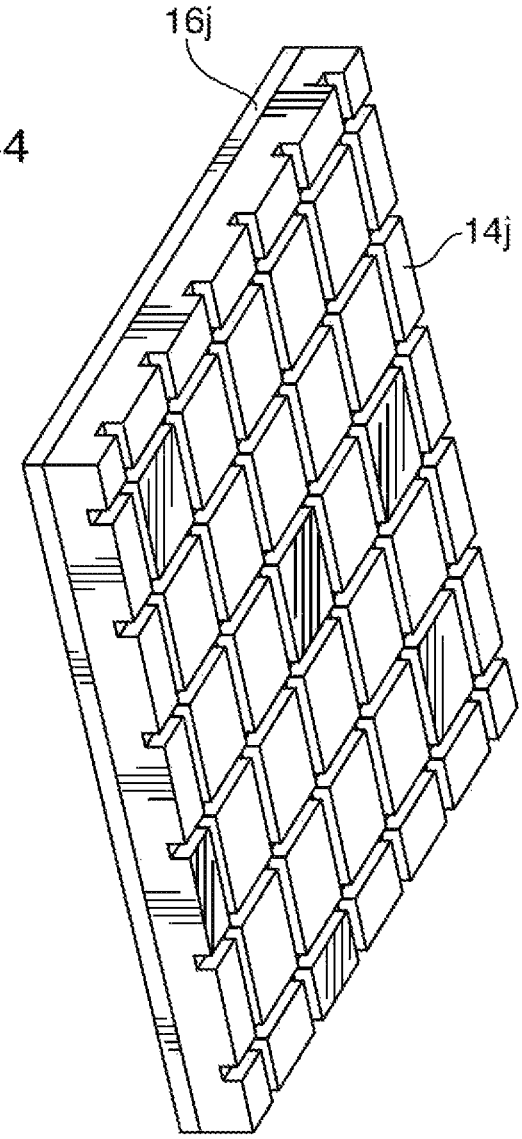
FIG. 44 is a perspective view of another alternative foam insulating panel and outer hardboard panel combination.

FIG. 44 is a perspective view of another alternative insulating foam panel 14*j* and outer hardboard panel 16*j*, that is similar to the embodiment shown in FIG. 43 but is formed as a square instead of a rectangle.

FIGS. 45 to 47 are front, end and side views of an alternative insulating foam panel 14*k* and outer hardboard panel 16*k*. It will be noted that this embodiment is similar to the combination shown in FIGS. 19 to 22 wherein circles are formed in a surface of the insulating foam panel 14*k* that faces the weather or water barrier. However, in this embodiment, the pattern of circles extends to the edges of the insulating foam panel 14*k* and the shapes at the edges are in fact half circles. When adjacent to a similar insulating foam panel 14*k* and outer hardboard panel 16*k*, the half circles of the adjacent panels 14*k* combine to form full circles at the periphery of the panels 14*k*, and a straight-through drainage channel 15 is not formed along the periphery of the adjacent panels 14*k*.

FIGS. 48 to 50 are front, end and side views of another alternative insulating foam panel 14*l* and outer hardboard panel 16*l*. This embodiment is similar to the embodiment shown in FIGS. 45 to 47, except that instead of circles it is ellipses that are formed in the surface of the insulating foam panel 14*l* facing the weather or water barrier and the drainage channels 15 are formed accordingly.

FIGS. 51 to 53 are front, end and side views of another alternative insulating foam panel 14*m* and outer hardboard panel 16*m*, having different sized rectangles formed in the surface of the insulating foam panel 14*m* that faces the weather or water barrier. Like in the embodiments of FIGS. 45 to 47 and 48 to 50, the rectangles reach the periphery of the insulating foam panel 14*m* and therefore a straight-through drainage channel 15 is not formed along the periphery of adjacent panels 14*m*.

Figure 54:
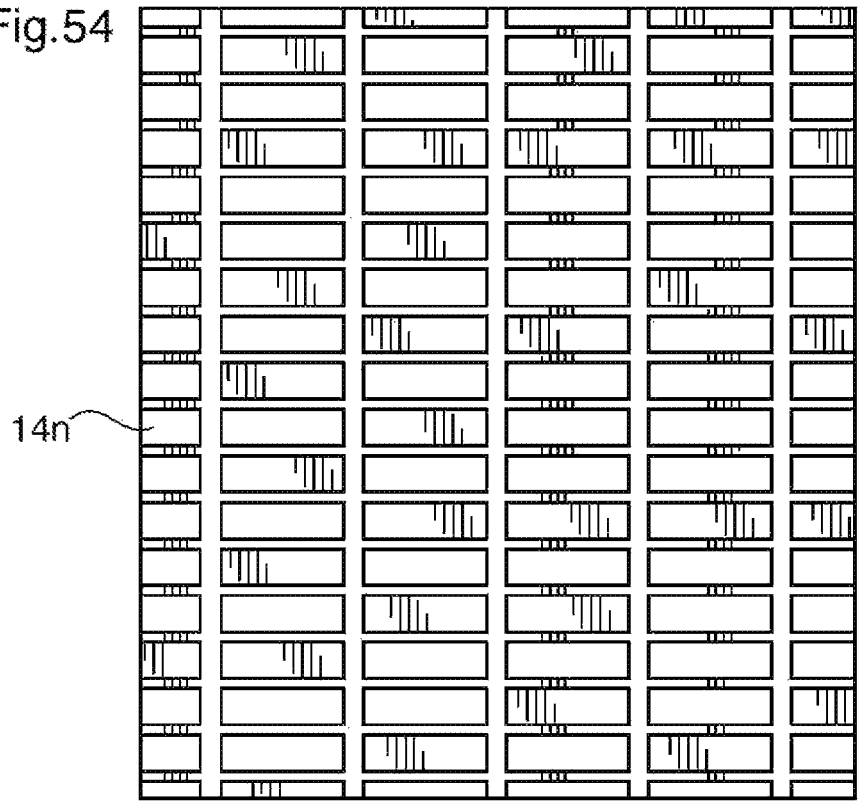
FIGS. 54 to 56 are front, end and side views of another alternative foam insulating panel and outer hardboard panel combination.
Figure 55:
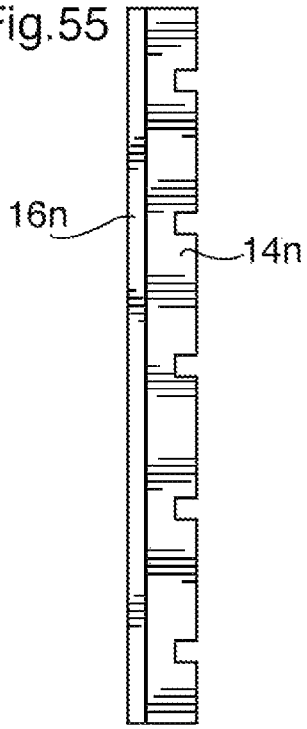
Figure 56:
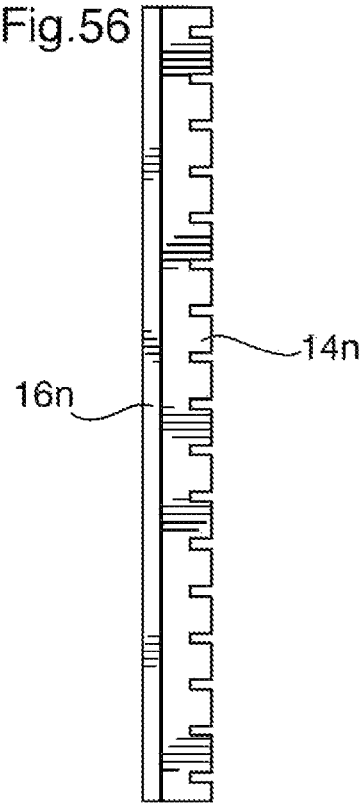

FIGS. 54 to 56 are front, end and side views of another alternative insulating foam panel 14*n* and outer hardboard panel 16*n*, having thin uniform rectangles formed in the surface of the insulating foam panel 14*n* that faces the weather or water barrier. Like in the embodiment of FIGS. 48 to 50, the rectangles reach the periphery of the insulating foam panel 14*n* and therefore a straight-through drainage channel 15 is not formed along the periphery of adjacent panels 14*n*.

Figure 57:
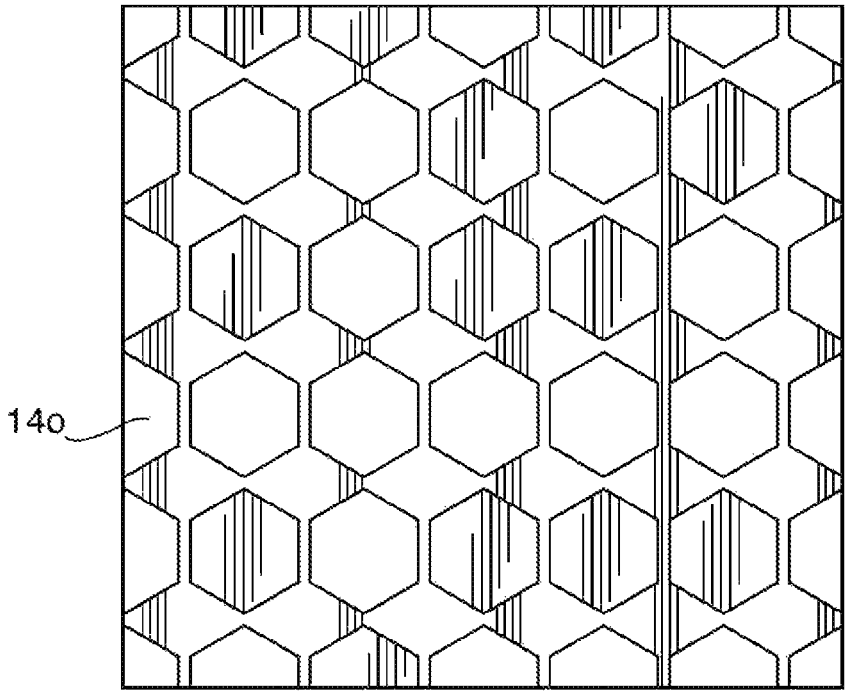
FIGS. 57 to 59 are front, end and side views of another alternative foam insulating panel and outer hardboard panel combination.
Figure 58:
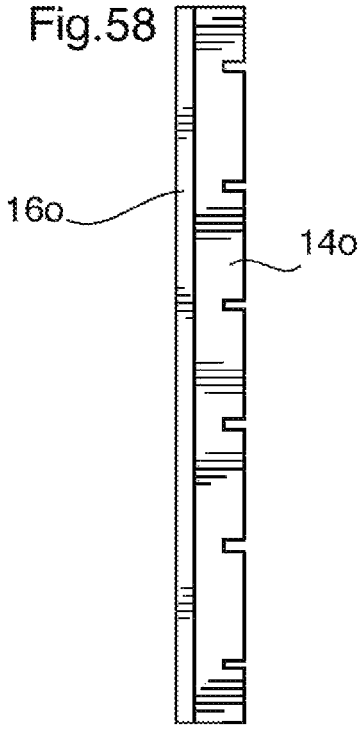
Figure 59:
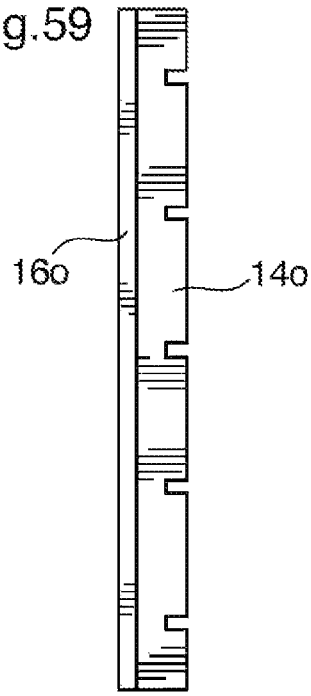

FIGS. 57 to 59 are front, end and side views of another alternative insulating foam panel 14*o* and outer hardboard panel 16*o*, having hexagons formed in the surface of the insulating foam panel 14*o* that faces the weather or water barrier. Like in the embodiment of FIGS. 48 to 50, the part-hexagons reach the periphery of the insulating foam panel 14*o* and therefore a full drainage channel 15 is not formed along the periphery of adjacent panels 14*o*.

Figure 60:
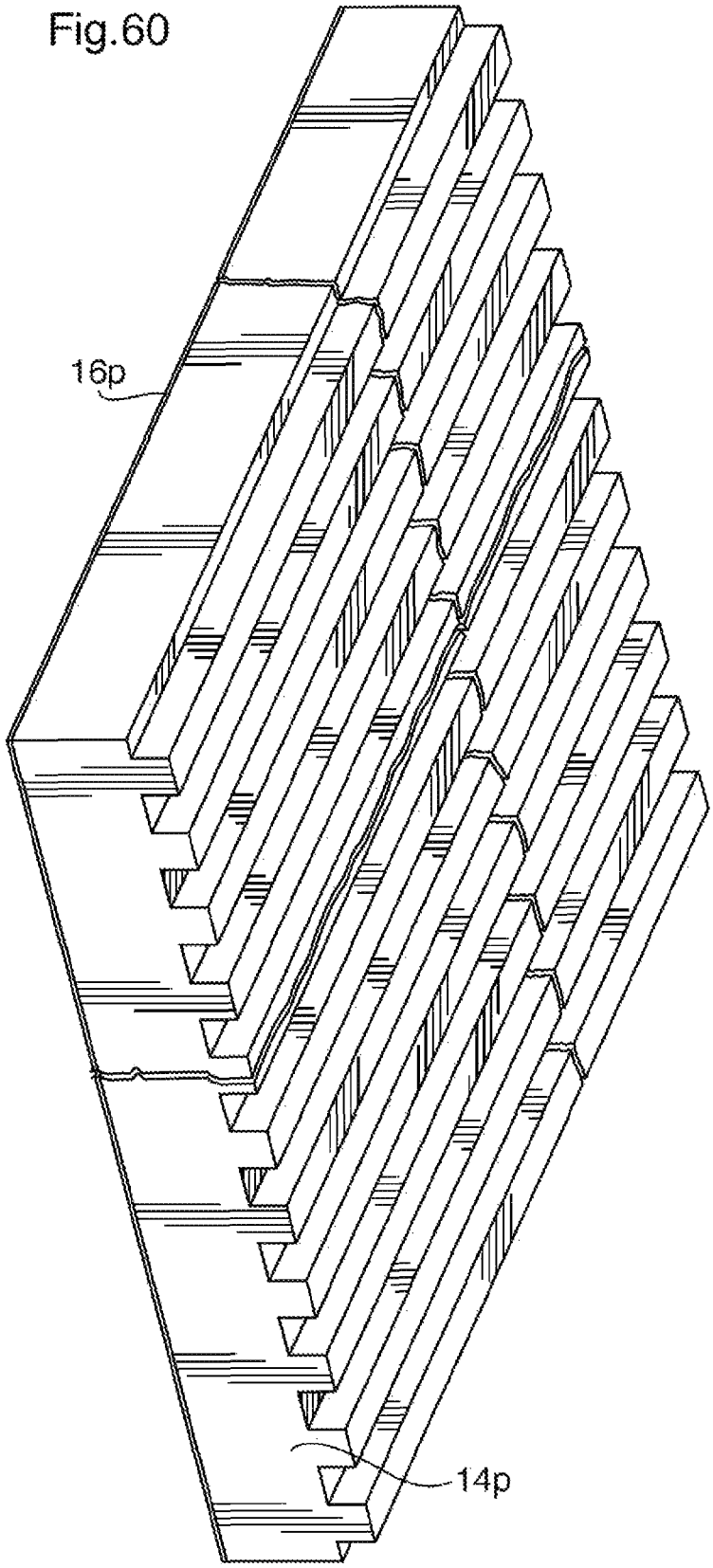
FIG. 60 is a perspective view of another alternative foam insulating panel and outer hardboard panel combination.

FIG. 60 is a perspective view of another alternative insulating foam panel 14*p* and outer hardboard panel 16*p*, having only vertical drainage channels 15 formed in a surface of the insulating foam panel 14*p* that faces the weather or water barrier.

What is claimed is:

1. A finishing arrangement for an exterior wall of a building, comprising:

a weather or water barrier against at least the exterior of the wall;

an outer hardboard panel;

an insulating foam panel between the weather or water barrier and the outer hardboard panel, the insulating foam panel attached to the outer hardboard panel and having drainage channels therein;

a drainage guide that extends from the weather or water barrier to at least the outer hardboard panel, for guiding moisture away from the wall; and at least one support member having a supporting surface for supporting at least part of the weight of at least the foam panel and the outer hardboard panel above the drainage guide, said surface extending from the weather or water barrier to at least the outer hardboard panel.

2. The arrangement of claim 1, wherein the at least one support member is a single support member that extends underneath and along at least the entire length of the foam panel and the outer hardboard panel.

3. The arrangement of claim 1, wherein the at least one support member comprises a channel.

4. The arrangement of claim 1, wherein the at least one support member and the drainage guide are a unitary structure.

5. The arrangement of claim 1, wherein the at least one support member comprises at least one hole therethrough for permitting moisture reaching the support member to fall through the at least one hole to the drainage guide.

6. The arrangement of claim 1, further comprising at least one fastener for fastening the foam panel and the outer hardboard panel to at least the exterior of the wall.

7. The arrangement of claim 6, wherein each of the at least one fastener is a screw dimensioned to extend through the foam panel and the outer hardboard panel into at least exterior of the wall.

8. The arrangement of claim 1, wherein the drainage channels in the insulating foam panel run horizontally and vertically along a surface thereof that faces the weather or water barrier.

9. The arrangement of claim 1, wherein the drainage channels in the insulating foam panel run diagonally along a surface thereof that faces the weather or water barrier.

10. The arrangement of claim 1, wherein the drainage channels in the insulating foam panel run along a surface thereof that faces the weather or water barrier, and are formed by a plurality of circles, ellipses, rectangles, diamonds, squares and/or hexagons formed in the surface facing the weather or water barrier.

11. The arrangement of claim 1, wherein the drainage guide extends underneath and along at least the entire length of the foam panel and the outer hardboard panel.

12. The arrangement of claim 11, wherein the drainage guide has a generally Z-shaped profile.

13. The arrangement of claim 12, wherein an end of the drainage guide extends upwards and between exterior sheathing and the weather or water barrier.

14. The arrangement of claim 1, wherein the outer hardboard panel is of a material selected from the group consisting of: fiber cement board, cement board, metal sheeting, and magnesium oxide board.

15. The arrangement of claim 14, wherein the outer hardboard panel is fiber cement board, and the fiber cement board is pre-painted.

16. The arrangement of claim 14, wherein the outer hardboard panel is metal sheeting, and the metal sheeting is formed of aluminum.

17. The arrangement of claim 16, wherein the aluminum is pre-painted.

18. The arrangement of claim 14, wherein the outer hardboard panel is metal sheeting, and the metal sheeting is formed of stainless steel.

19. The arrangement of claim 18, wherein the stainless steel is pre-painted.

20. The arrangement of claim 14, wherein the outer hardboard panel is cement board, and the arrangement further comprises stucco applied to the outer surface of the cement board.

21. The arrangement of claim 1, wherein the foam panel and the outer hardboard panel are attached to each other with glue.

* * * * *